US005450937A

United States Patent [19]

Ono et al.

[11] Patent Number: 5,450,937

[45] Date of Patent: Sep. 19, 1995

[54] PAPER CURRENCY DISCRIMINATING DEVICE

[75] Inventors: Takashi Ono, Sakado; Yoshinori Maruyama, Kawagoe; Masayuki Watabe, Iruma; Kenji Nishiumi, Hanno, all of Japan

[73] Assignee: Nippon Conlux Co., Ltd., Tokyo, Japan

[21] Appl. No.: 164,414

[22] Filed: Dec. 9, 1993

[30] Foreign Application Priority Data

Dec. 10, 1992 [JP] Japan ..... 4-352511
Oct. 20, 1993 [JP] Japan ..... 5-284131

[51] Int. Cl.[6] ..... G07D 7/00
[52] U.S. Cl. ..... 194/203; 194/206
[58] Field of Search ..... 194/203, 206, 207; 382/7

[56] References Cited

U.S. PATENT DOCUMENTS

| | | | |
|---|---|---|---|
| 4,556,139 | 12/1985 | Akagawa et al. | 194/207 |
| 4,880,096 | 11/1989 | Kobayashi et al. | 194/206 |
| 5,195,739 | 3/1993 | Watabe | 194/203 X |
| 5,259,490 | 11/1993 | Gardellini | 194/203 |
| 5,316,117 | 5/1994 | Griner et al. | 194/203 |
| 5,325,952 | 7/1994 | McGinley et al. | 194/203 |
| 5,333,714 | 8/1994 | Watabe et al. | 194/206 |

FOREIGN PATENT DOCUMENTS

| | | | |
|---|---|---|---|
| 4123887 | 1/1992 | Germany | 194/203 |
| 3214386 | 9/1991 | Japan | 194/203 |

*Primary Examiner*—Michael S. Huppert
*Assistant Examiner*—Scott L. Lowe
*Attorney, Agent, or Firm*—Koda and Androlia

[57] ABSTRACT

A paper currency discriminating device which is improved to prevent the illegal extraction of paper currency more reliably. An impeller 10 associated in the rotating direction of timing belts 14 for transferring the paper currency is so disposed at the exit of a paper currency transfer passage 6 as to protrude upward over the paper currency transfer face of an upper transfer plate 3. Moreover, the impeller 10 at the time of introducing the paper currency is inhibited from backward rotation to prevent any illegal extraction of the paper currency once introduced. At the same time, a decision signal is outputted after it is detected by a passage detection sensor P3 that the trailing end of the paper currency being transferred reaches the impeller 10 over an extraction preventing lever 33. As a result, it is possible to prevent the illegal use of the paper currency by the extraction which is done before the end of the introduction. Moreover, the illegal recovery of the paper currency by abusing the opening action of the paper currency transfer passage 6 is prevented by preventing any additional insertion of paper currency by closing the paper currency transfer passage 6 with a shutter member 24 till the introduction of the paper currency is ended.

17 Claims, 12 Drawing Sheets

PAPER CURRENCY DISCRIMINATING DEVICE

BACKGROUND OF THE INVENTION

1. Field of the Invention

The present invention relates to an improvement in a paper currency discriminating device and, more particularly, to a prevention of an illegal extraction of paper currency.

2. Description of the Related Art

The paper currency discriminating device has its paper currency transfer passage formed by two transfer plates which are arranged to face each other at a predetermined clearance. This paper currency transfer passage is arranged therein with: paper currency transfer means composed of belts, rollers and so on; and information detecting means for discriminating the paper currency such as magnetic heads and optical sensors. While the paper currency inserted into the paper currency discriminating device is being transferred by the paper currency transfer means, information for the discrimination is collected from the paper currency by the magnetic heads, the optical sensors and so on so that the genuineness/counterfeitness and kind of the paper currency may be decided on the basis of that discrimination information.

However, there are frequently tried the illegal operations, in which a thread or tape is attached to the paper currency so that the paper currency may be returned by the thread or tape after the decision of the genuineness of the paper currency and the output of the decision signal have been ended or after the introduction of the paper currency has been once ended. This raises a problem that the paper currency having triggered the output of a genuineness signal for allowing the sales conducts of an automatic vendor or the use of a game machine is returned back by the user himself although the genuineness signal was outputted from the paper currency discriminating device.

In order to solve this problem, there has been proposed the paper currency discriminating device, in which a shutter member for closing the paper currency transfer passage is arranged downstream of the information detecting means such as the magnetic heads or the optical sensors so that the decision signal is outputted after the paper currency transfer passage has been closed when the paper currency passed over the shutter member, as disclosed in Japanese Patent Laid-Open No. 130096/1979 and Japanese Utility Model Publications Nos. 33421/1980 and 4956/1973.

There also has been proposed a paper currency discriminating device, in which the shutter member for closing the paper currency transfer passage is arranged upstream of the information detecting means such as the magnetic heads and the optical sensors so that the collection of the discrimination information and the output of the decision signal may be executed while inhibiting the extraction of the inserted paper currency by holding it completely in the paper currency transfer passage, as disclosed in Japanese Utility Model Laid-Open No. 16363/1988 and Japanese Patent Laid-Open No. 32694/1976. However, either type of the proposals has an insufficient function to close the passage with the shutter member and has taken no consideration into the continuous insertion of paper currency although it is intended to prevent the extraction by a simple returning action to be effected by attaching the thread or tape to the paper currency. As a result, in the case of the continuous insertion of paper currency, the shutter member required to inhibit the extraction may be opened in response to the detection of insertion of the first paper currency so that the paper currency subsequently inserted may possibly be extracted by the illegal action.

OBJECT AND SUMMARY OF THE INVENTION

In a paper currency discriminating device comprising: a paper currency transfer passage having upper and lower transfer plates facing each other at a predetermined clearance; a paper currency transfer means for transferring the paper currency inserted from one end of the entrance of the paper currency transfer passage to the other end of the exit of the same along the paper currency transfer passage; a paper currency insertion sensor for detecting that the paper currency has been inserted into the paper currency transfer passage; and paper currency information detecting means for discriminating the paper currency in the paper currency transfer passage, an object of the present invention is to eliminate the aforementioned defect of the prior art and to improve the paper currency discriminating device such that it can prevent the illegal extraction of paper currency more reliably.

According to one mode of the present invention, there is disposed outside of the exit of the paper currency transfer passage an impeller which is spaced at a predetermined gap from the edge of the upper transfer plate and the vanes of which have their leading ends protruding upward over the paper currency transfer face of the upper transfer plate. Moreover, this impeller is rotationally driven by a drive source for driving the paper currency transfer means or allowed to rotate only in the paper currency transferring direction but inhibited in the reverse direction. As a result, even if the thread or tape attached to the paper currency is pulled to extract the paper currency after the paper currency has passed over the impeller, this extraction is blocked because the paper currency has its end caught by the vane or vanes of the reversely irrotational impeller.

According to another mode of the present invention, there is arranged outside of the exit of the paper currency transfer passage the paper currency forcibly transfer means for forcibly transferring the paper currency, which is fed out from the paper currency transfer passage, in the direction apart from the exit of the paper currency transfer passage. Moreover, the lower transfer plate is formed with a projection at the exit of the paper currency transfer passage and at its widthwise central portion. This projection is shaped to extend in the paper currency transferring direction of the paper currency transfer passage and downward at an inclination to have its leading end extended to a position slightly exceeding the paper currency transfer passage defined by the paper currency forced transfer means, so that it may not block the transfer of the paper currency being transferred from the exit of the paper currency transfer passage by the paper currency forced transfer means but may block the reverse movement of the paper currency if the paper currency positioned below the position of the paper currency forced transfer means is moved backward to the exit of the transfer passage.

According to still another mode of the present invention, there is arranged an extraction preventing lever made of a plate-shaped member, which has its base end hinged rotatably to the upper transfer plate and a width substantially equal to that of the paper currency, and shaped to be extended in the transfer direction of the paper currency transfer passage and bent downward to have reach partially the paper currency transfer face of the lower transfer plate over the paper currency transfer face of the lower transfer plate, so that it may prevent the paper currency, which has been once discharged to the outside from the exit of the paper currency transfer passage, from being returned from the discharged position and moved back from the exit of the paper currency transfer passage to the paper currency transfer passage, and there is further disposed a paper currency passage detecting sensor for discriminating the state, in which the extraction preventing lever is turned by having its leading end pushed up by the paper currency being transferred in the vicinity of the exit of the paper currency transfer passage, and the state in which the extraction preventing lever is turned downward because no paper currency is present at the leading end thereof. Thus, if it is detected by the paper currency passage detecting sensor that the paper currency has passed while pushing up the extraction preventing lever, this passage detection signal is fed to the paper currency information detecting means to allow the output of a paper currency decision signal based upon the discrimination signal read by the paper currency information detecting means.

DETAILED DESCRIPTION OF THE PREFERRED EMBODIMENTS

Figure 1:
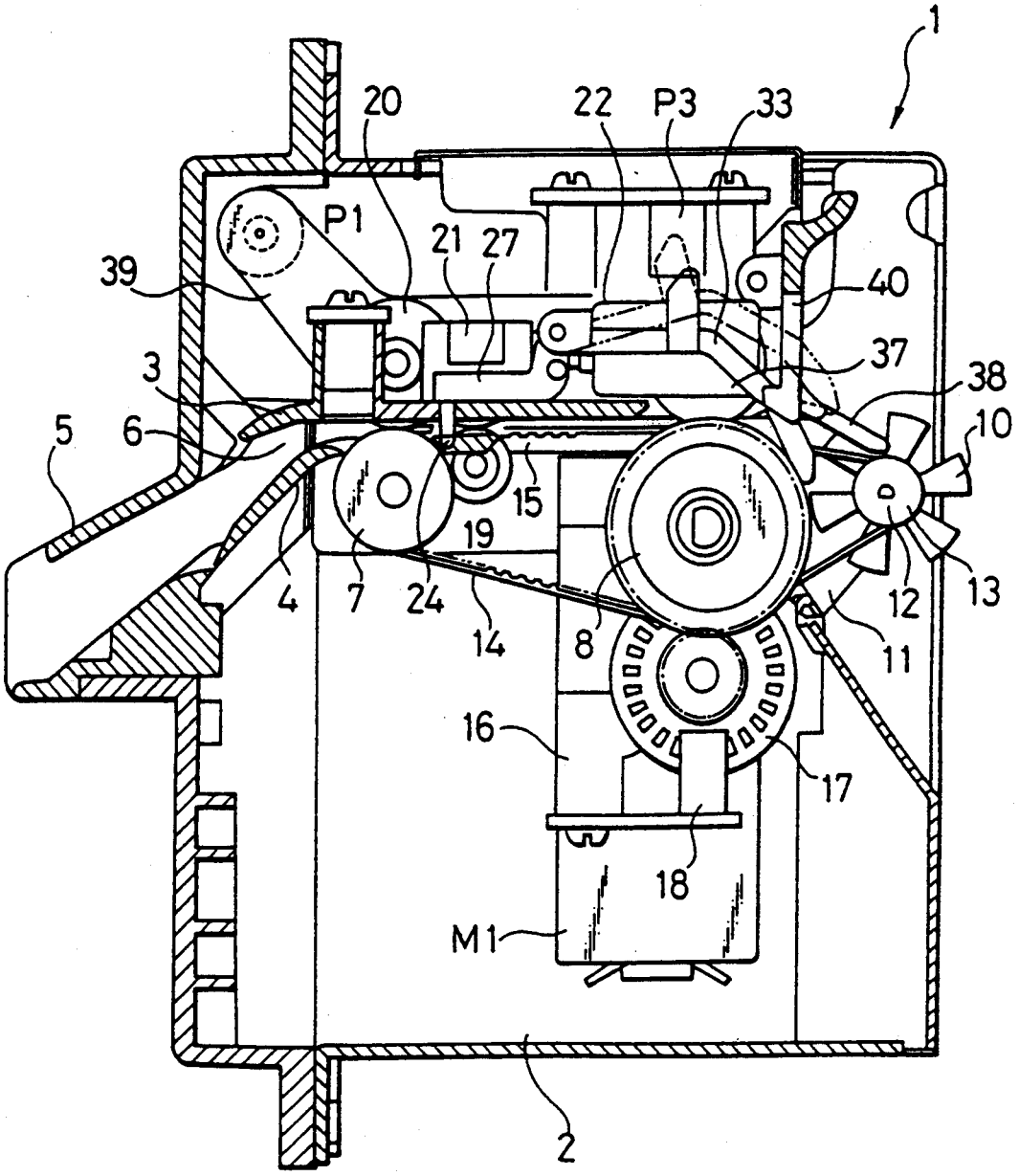
FIG. 1 is a section showing an essential portion of a paper currency discriminating device according to one embodiment of the present invention.
Figure 2:
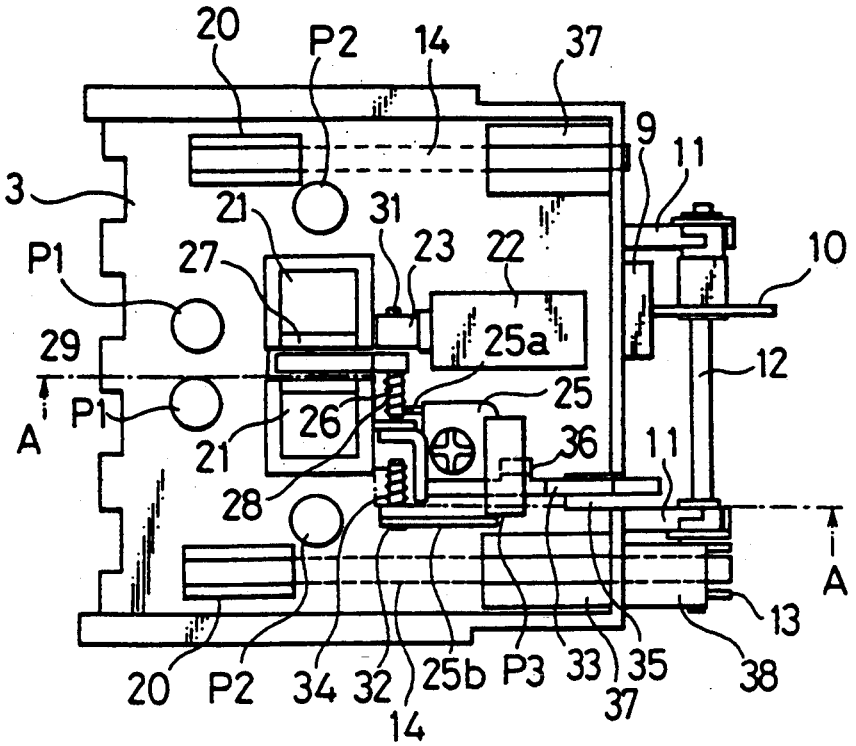
FIG. 2 is a top plan view schematically showing the upper transfer plate and the lower transfer plate of the paper currency discriminating device of the same embodiment together with their related functional parts.

The present invention will be described in the following in connection with its embodiments with reference to the accompanying drawings. FIG. 1 is a sectional side elevation showing an essential portion of the construction of a paper currency discriminating device 1 according to one embodiment; FIG. 2 is a schematic top plan view showing an upper transfer plate 3 mounted in a casing 2 of the paper currency discriminating device 1 together with functional parts which are provided in relation to that plate 3; and FIG. 3 is a section taken in the direction of arrows A—A of FIG. 2.

From the front face of the casing 2, there is projected a front mask 5 which is formed with a paper currency insert, as shown in FIG. 1. This paper currency insert of the front mask 5 has communication with a paper currency passage 6 which is formed of a clearance between the upper transfer plate 3 and a lower transfer plate 4. This lower transfer plate 4 is equipped at the two sides of its lower face near the front mask 5 with a pair of driven timing pulleys 7 and 7 which can rotate. The plate 4 is further equipped with a pair of drive timing pulleys 8 and 8 at the two sides of its lower face near the back. As better seen from FIGS. 2 and 3, moreover, there is projected at the exit of the paper currency passage 8 a tongue-shaped projection 9 which is located at one side of the edge of the upper transfer plate 3. An impeller 10 is integrally fixed on a shaft which is rotatably borne by support members 11 projected from the two sides of the exit end of the lower transfer plate 4. A timing pulley 13 having a smaller diameter is fixed on one end of the shaft 12.

Figure 3:
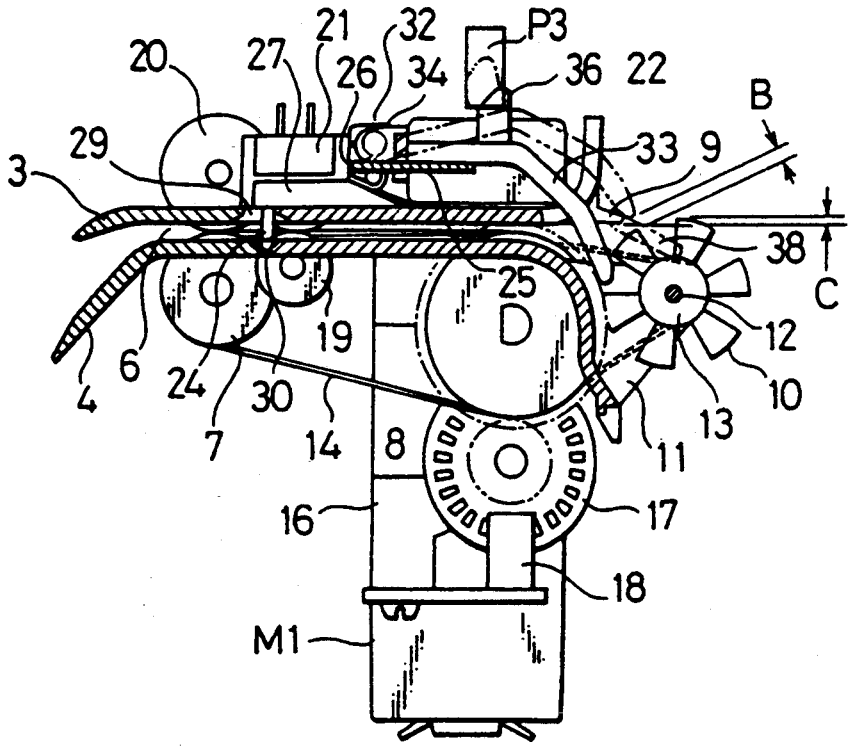
FIG. 3 is a sectional view presenting a section taken in the direction of arrows A—A of FIG. 2.

The impeller 10 is arranged to have a predetermined gap B, as indicated in FIG. 1, from the tongue-shaped projection 9 and to be higher by a distance C, as indicated in FIG. 3, than the paper currency transfer face of the upper transfer plate 3.

Between one driven timing pulley 7 and one drive timing pulley 8, as shown in FIG. 2, there is made to run a timing belt 14 which constitutes paper currency transfer means. Among the other driven timing pulley 7, the other drive timing pulley 8 and the smaller timing pulley 13, there is made to run another timing belt 14 which also constitutes the paper currency transfer means.

The lower transfer plate 4 is formed, as shown in FIG. 1, with a through groove 15 which extends in the paper currency transferring direction between the positions where the individual pulleys 7 and 8 are arranged. The two timing belts 14 individually rise slightly into the paper currency transfer passage 6 from the back of the lower transfer plate 4 so that they can contact with the paper currency in that passage 6. The drive timing pulleys 8 and 8 carrying the timing belts 14 and 14 are rotationally driven by a DC motor M1 through a variety of power transmission means which are arranged in a gear casing 16 fixed at the lower side of the lower transfer plate 4. At one side of the gear casing 16, there is disposed a perforated disc 17 which is rotated by the inside power transmission means. A rotation detector 18 composed of a light emitting element or a photoelectric converter is arranged to interpose the perforated disc 17.

Thus, when the DC motor M1 is energized, the drive timing pulleys 8 are rotated through the power transmission means in the gear casing 16. As a result, both one timing belt 14 between one driven timing pulley 7 and one drive timing pulley 8 and the other timing belt 14 among the other driven timing pulley 7, the other drive timing pulley 8 and the smaller timing pulley 13 are rotationally driven. At the same time, the impeller 10 is rotationally driven in the same direction as that of the timing belt 14 acting as the paper currency transfer means. Since the running velocity of the timing belt 14 and the circumferential velocity of the smaller timing pulley 13 are equal, the impeller 10 having a larger diameter than that of the timing pulley 13 acquires a circumferential velocity higher to some extent than those velocities.

Since the perforated disc 17 is rotated at a constant velocity ratio to the drive timing pulleys 8 by the rotational drive of the DC motor M1, a rotational position detecting signal is outputted from the photoelectric converter of the rotation detector 18 each time the drive timing pulleys 8 rotate a predetermined amount, that is, each time the paper currency in the passage 6 is fed a predetermined amount. The lower transfer plate 4 is equipped between the driven timing pulleys 7 and the drive timing pulleys 8 with two pinch rollers 19 which are juxtaposed to each other at a constant spacing in the widthwise direction of the paper transfer passage 6.

At the two sides of the upper face of the upper transfer plate 3 near the front mask 5, that is, at the two sides near the entrance of the paper currency transfer passage 6, on the other hand, there is provided a paper currency insertion sensor P1 which is composed of optical sensors juxtaposed to each other at a constant spacing in the widthwise direction of the paper currency transfer passage 6. Moreover, a pair of guide rollers 20 and 20 are arranged to correspond to the driven timing pulleys 7 at the lower transfer plate 4 and are borne by the upper transfer plate 3. These guide rollers 20 are so urged in a direction to protrude partially into the paper currency transfer passage 6 through the clearance of the upper transfer plate 3 that they may push and clamp the paper currency together with the timing belts 14 made to run on the driven timing pulleys 7. Moreover, the upper transfer plate 3 is equipped with two magnetic heads 21 acting as information detecting means, which are so juxtaposed to each other as to correspond to the position where the pinch rollers 19 are arranged at the lower transfer plate 4. The magnetic heads 21 read the information for deciding the genuineness/counterfeitness and kind of the paper currency which is being conveyed while being under pressure by the pinch rollers 19. Outside of the two magnetic heads 21, on the other hand, there is arranged a transfer position detecting sensor P2 which is composed of optical sensors juxtaposed to each other at a constant spacing in the widthwise direction of the paper currency transfer passage 6.

On the upper transfer plate 3 slightly downstream of the position of the magnetic heads 21, as taken in the transfer direction of the paper currency, there is fixed a pull-type solenoid 22 which is operated by its movable iron core 23 to protrude or contract a shutter member 24 into or out of the paper currency transfer passage 6 slightly upstream of the magnetic heads 21 in the transfer direction. The shutter member 24 is formed into a needle shape and is fixedly carried on the leading end of an L-shaped rocking arm 27, which is rockably borne on a shaft 26 fixed on a bent portion **25*a* of a bracket member 25 fastened on the upper face of the upper transfer plate 3 by means of screws. The rocking arm 27 is biased to rock counter-clockwise of FIG. 3 on the shaft 26 by the action of a coil spring 28. This coil spring 28 is mounted around the shaft 26 while having its two ends retained by the upper face of the upper transfer plate 3 and the inside bent portion of the rocking arm 27. In the deenergized state of the solenoid 22, therefore, the shutter member. 24 carried on the leading end of the rocking lever 27 biased by the coil spring 28 is protruded into the paper currency transfer passage 6 through a hole 29 of the upper transfer plate 3 and further into a hole 30 of the lower transfer plate 4. As a result, the paper currency transfer passage 6 is shut at a position slightly upstream of the magnetic heads 21** in the transfer direction.

On the movable iron core 23 of the solenoid 22, there is carried an engagement pin 31. This pin 31 is in engagement with the rocking arm 27 slightly above the position where the shaft 26 is mounted. As a result, the rocking arm 27 can be given a clockwise turning moment, as viewed in FIG. 3, by the extraction and contraction of the movable iron core 23 caused by the energized solenoid 22. As a result, when the solenoid 22 is energized, the rocking arm 27 is turned clockwise on the shaft 26 so that the shutter member 24 is retracted from the paper currency transfer passage 6 to open it.

On a shaft 32 which is fixed on the other bent portion **25*b* of the bracket member 25, there is rockably borne an extraction preventing lever 33 which has a U-shaped body. This lever 33 is biased to rock clockwise of FIG. 3 on the shaft 32 by the action of a coil spring 34 which is mounted around the shaft 32 while having its two ends retained by the U-shaped body of the lever 33 and the upper face of the bracket member 25. The extraction preventing lever 33 has its leading end ex tended obliquely downward into the gap between the impeller 10 and the lower transfer plate 4 after it has passed through a notch 35 formed in the upper transfer plate 3. In short, the lever 33 protrudes slightly below the paper currency transfer face of the lower transfer plate 4**.

The extraction preventing lever 33 is integrally formed at its central portion with a shielding member 36 which is extended upward. The lever 33 has its rocking position detected when the shielding member 36 is detected by a passage detecting sensor P3 which is composed of a light emitting element and a photoelectric converter. If the extracting preventing lever 33 is rocking till its leading end protrudes downward across the paper currency transfer face of the lower transfer plate 4, the passage detecting sensor P3 is turned OFF by the shielding member 36 brought to the position at that time. The sensor P3 is ON while the lever 33 is out of that position.

Slightly below the positions of the solenoid 22 and the bracket member 25, as taken along the paper currency transfer direction, there are disposed a pair of guide rollers 37 and 37 which correspond to the position of the drive timing pulleys 8 in the lower transfer plate 4. These guide rollers 37 and 37 are rotatably borne on the upper transfer plate 3. The guide rollers 37 are made to have a construction similar to that of the aforementioned guide rollers 20 so that they clamp the paper currency under pressure together with the timing belts 14 made to run on the drive timing pulleys 8.

The upper transfer plate 3 is integrally formed at one side of its exit edge, as corresponds to the position of the smaller timing pulley 13 for rotating the impeller 10, with a projection 38 which is so extended downward over the paper currency transfer face of the lower transfer plate 4 as to cover the timing belt 14 and the timing pulley 13.

The upper transfer plate 3 having those members mounted thereon is rockably hinged to the inner sides of the casing 22 through mounting arms 39 which are formed integrally therewith. The plate 3 is held at a constant clearance from the lower transfer plate 4 to form the paper currency transfer passage when it is fixed by a control lever 40 attached to its exit end portion.

Figure 4:
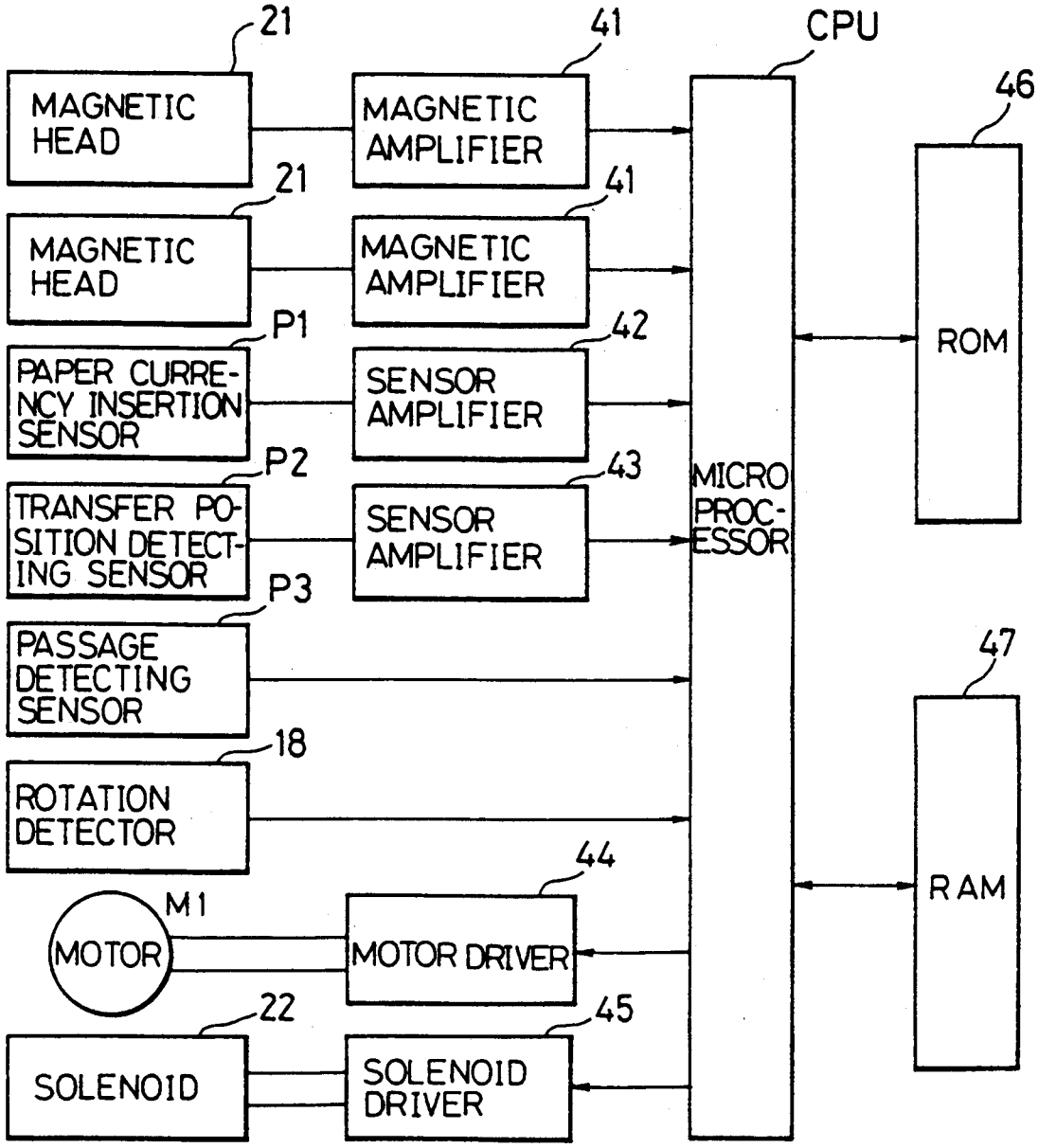
FIG. 4 is a schematic block diagram showing control means for driving the paper currency discriminating device of the same embodiment.
Figure 5:
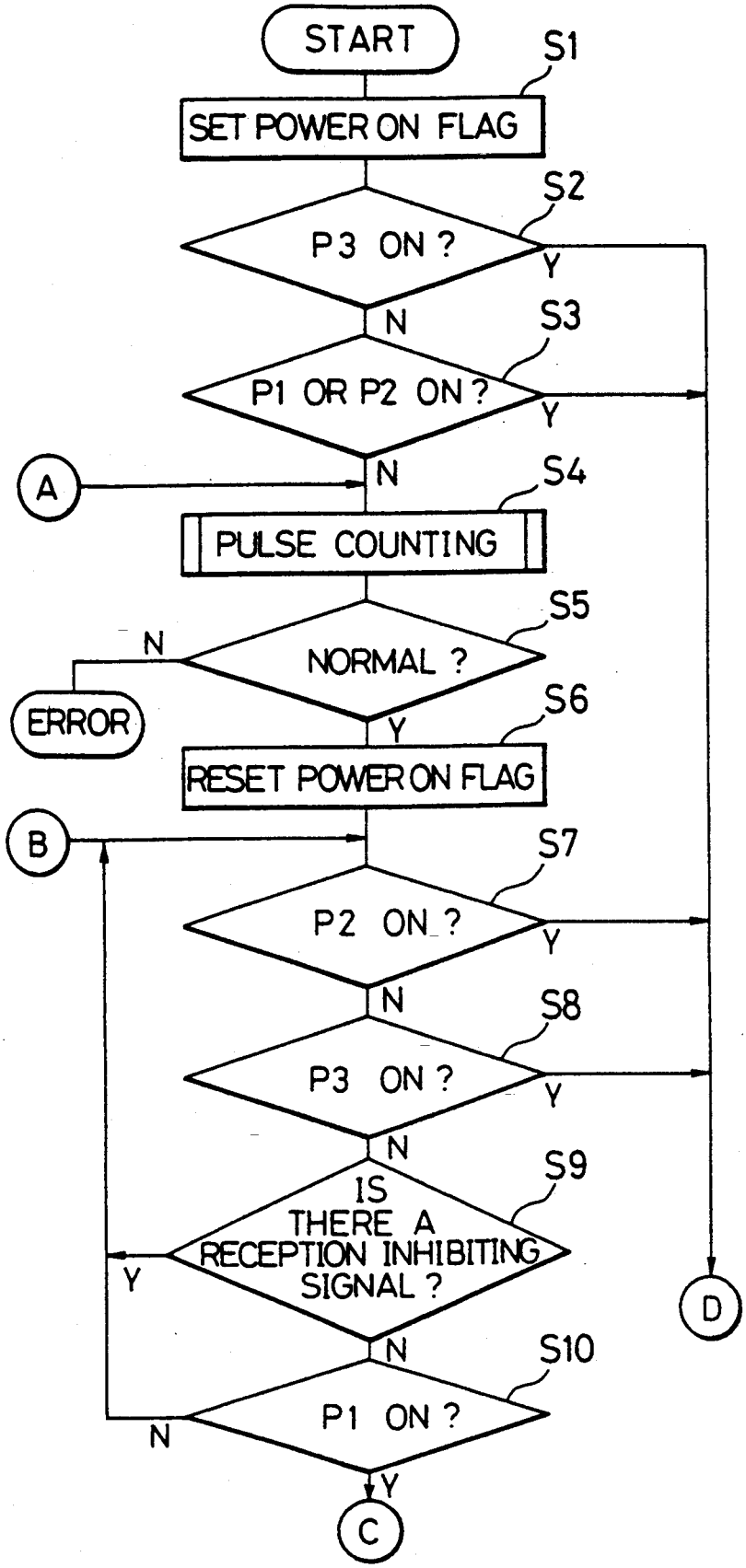
FIG. 5 is a schematic flow chart showing a control program for the paper currency discriminating device of the same embodiment.
Figure 6:
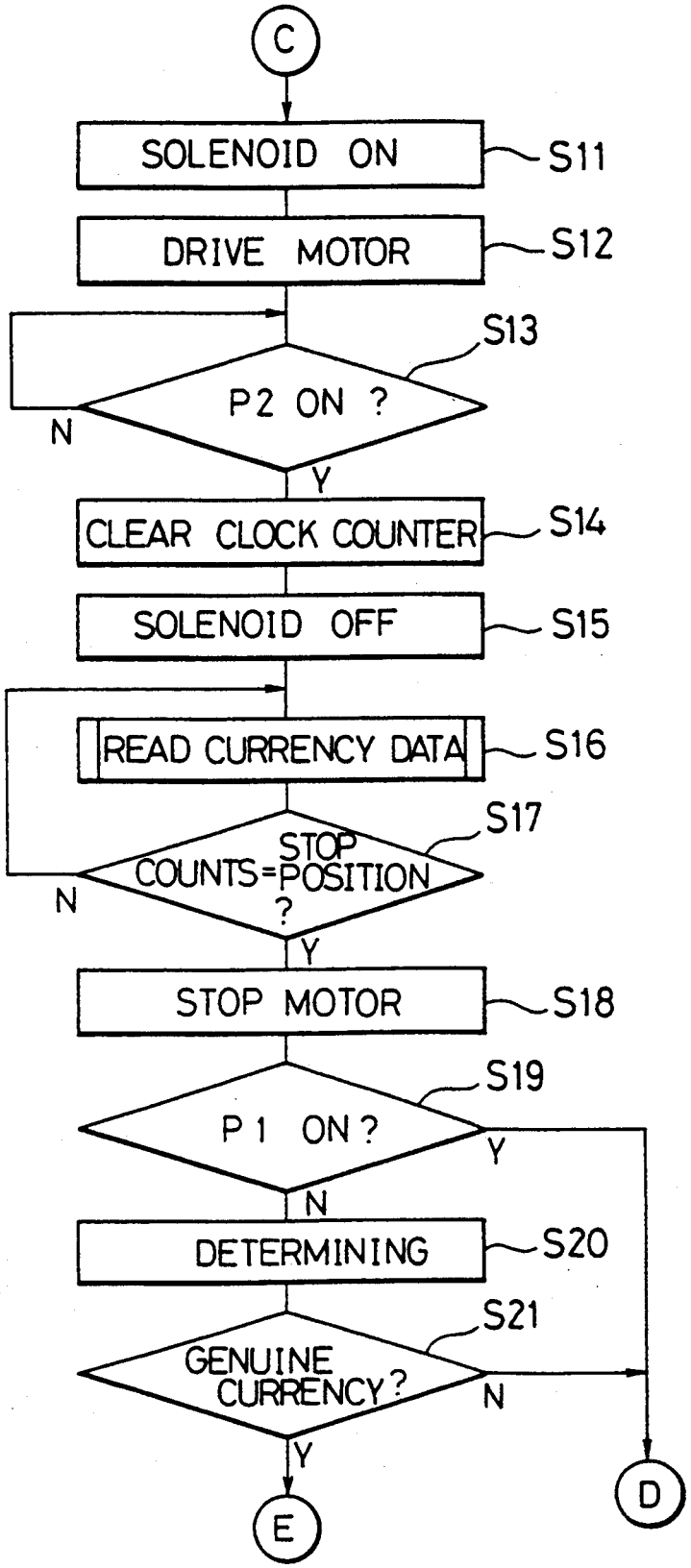
FIG. 6 is a continuation of the flow chart schematically showing the control program.

FIG. 4 is a block diagram schematically showing the control means for driving the paper currency discriminating device 1. The magnetic heads 21 and 21 acting as the information detecting means for detecting the magnetic components contained in the ink of the paper currency to collect the discrimination data are connected through magnetic amplifiers 41, respectively, with a microprocessor (as will be shortly called the "CPU") in the paper currency discriminating device 1. Moreover, the paper insertion sensor P1 (of the photoelectric converters) and the transfer position detecting sensor P2 (of the photoelectric converters) for detecting the optical transmittance of the paper currency to collect the discrimination data are also connected through sensor amplifiers 42 and 43, respectively, with the CPU. The discrimination data collected by the magnetic heads 21, the paper currency insertion sensor P1 and the transfer position detecting sensor P2 are processed by the CPU and are stored in a RAM 47 of the paper currency discriminating device 1. In case, however, the present position of the paper currency is to be detected, it is decided whether or not the outputs of the sensor amplifiers 42 and 43 are below the predetermined values for detecting the ON/OFF of the sensors P1 and P1, and P2 and P2.

Further connected with the CPU are the rotation detector 18 for detecting the :rotating state of the timing belts 14 constituting the paper currency transfer means and the passage detecting sensor P3 for detecting the rocking state of the ex traction preventing lever 33.

On the other hand, the DC motor M1 for driving the timing belts 14 and the solenoid 22 for controlling the shutter member 24 are controlled through a motor driver 44 and a solenoid driver 45 in response to commands coming from the CPU. A ROM 46 is a nonvolatile memory which is stored with control programs for controlling the drives of the individual portions of the paper currency discriminating device 1, and the RAM 47 is a memory which is used to store the data temporarily.

FIGS. 5 to 8 are separated flow charts schematically showing the control programs which are stored in the ROM 46. On the other hand, FIGS. 9 to 12 are timing charts showing the detecting states of the individual sensors and the operating state of the DC motor M1, respectively, when the paper currency is normally transferred, when the paper currency is continuously inserted and when a illegal extraction occurs. The processing operations of the paper currency discriminating device 1 according to the present embodiment will be described in the following with reference to those flow charts and timing charts. In these flow charts, the routine of Steps S1 to S10 relate mainly to a malfunction detection, when the power is supplied, and a standby operation for awaiting the insertion of paper currency, and the routine of Steps S11 to S21 relates to the introduction and discrimination of paper currency. Moreover, the routine of Steps S22 to S30 relates mainly to the detection of the extraction of paper currency and the inhibition of continuous insertion of paper currency, and the routine of Steps S31 to S44 relates to the return of counterfeit paper currency and the return of additionally inserted paper currency and to the routine of recovering a trouble corresponding to the detection of a malfunction at the time of power supply.

First of all, when the power is supplied to the paper currency discriminating device 1, the CPU detects the power supply and sets a power ON flag (at Step S1) in a predetermined bit of the RAM 47. Then, the CPU decides (at Step S2) whether or not the passage detecting sensor P3 is ON, that is, whether or not the extraction preventing lever 33 has returned to the normal standby position, as indicated by solid lines in FIG. 1. If the passage detecting sensor P3 is OFF, the CPU further decides (at Step S3) whether or not either the paper currency insertion sensor P1 disposed at the entrance of the paper currency transfer passage 6 or the transfer position detecting sensor P2 disposed at the two sides of the magnetic heads 21 has been ON. Usually, the paper currency is neither present in the paper currency transfer passage 6 at the stage immediately after the power has been supplied nor is inserted simultaneously with the power supply, so that both the answers of Steps S2 and S3 are NO (as abbreviated to "N").

If, at this stage, the answer of Step S2 or S3 is YES (as abbreviated to "Y"), it implies either that the jamming with the paper currency having occurred when the power was turned OFF has not been solved yet or that the passage detecting sensor P3, the paper currency insertion sensor P1 or the transfer position detecting sensor P3 itself has gone out of order. Thus, the CPU once skips to the operation of Step S31 to begin restoration of the trouble.

At Step S31, the CPU outputs at first a command to stop the DC motor M1, and this operation is to interrupt the run of the timing belts 14 so as to return the counterfeit paper currency and the additionally inserted paper currency, if any. However, this operation has no substantial meaning at the stage before the drive of the DC motor M1 is not started yet, that is, in case the operation of Step S31 is executed after skipped from the decision of Step S2 or S3.

The CPU thus having started the recovery from a trouble then outputs a drive command to the solenoid driver 45 (as shown in FIG. 4) to energize the solenoid 22 (at Step S32) thereby to retract the shutter member 24 from the paper currency transfer passage 6. Next, the CPU outputs a reversing command to the motor driver (as shown in FIG. 4) of the DC motor M1 (at Step S33); sets the timer with a predetermined operation period (e.g., 4 secs in the embodiment) to start the timing operation (at Step S34); and decides, before the operation period of the timer elapses (at Step S40), whether or not the transfer position detecting sensor P2 is OFF (at Step S35), whether the passage detecting sensor P3 is OFF (at Step S36) and whether or not the paper currency insertion sensor P1 is OFF (at Step S37).

If all the transfer position detecting sensor P2, the passage detecting sensor P3 and the paper currency insertion sensor P1 are turned OFF before the operation period of the timer elapses after the reverse drive of the timing belts 14 has been started, that is, if all the answers of decisions of Steps S35 to S37 are NO, it is meant that the jamming paper currency has been automatically discharged to recover the trouble by the reverse drive of the timing belts 14. Thus, the CPU outputs a stop command to the motor driver 44 of the DC motor M1 (at Step S38) to interrupt the reverse drive of the timing belts 14 and releases the energization of the solenoid 22 (at Step S39). After this, the CPU decides (at Step 44) whether or not the power ON flag has been set, that is, whether or not the foregoing operations of Steps S31 to S40 have been carried out to recover the trouble immediately after the power was supplied. In this ease, the operations from Step S31 to S40 relate to those for recovering the trouble immediate after the power supply on the basis of the answer of decision of Step S2 or S3, and the power ON flag is held in the set state by the operation of Step S1 so that the answer of Step S44 is YES. Thus, the CPU skips to Step S4, at which it continues the operation for shooting the trouble.

If any of the transfer position detecting sensor P2, the passage detecting sensor P3 and the paper currency insertion sensor P1 is not turned OFF before the operation period of the timer elapses after the reverse drive of the timing belts 14 has been started, that is, if the answer of decision of Step S40 is YES, it is recognized either that the trouble detected at Step S2 or S3 cannot be automatically recovered no matter what a simple jamming it might be or that at least one of the transfer position detecting sensor P2, the passage detecting sensor P3 and the paper currency insertion sensor P1 is troubled. Thus, the CPU outputs a stop command to the motor driver 44 of the DC motor M1 (at Step S41) to stop the reverse drive of the timing belts 14 and releases the energization of the solenoid 22 (at Step S42). In this case, one or more sensors are always ON so that the CPU repeats the execution of the decision of Step S43 to await the operator's operation for recovery from the trouble such as the discharge of the jamming paper currency or the remedy of the sensor or sensors. When the trouble is eliminated by such recovery work by the operator, the CPU executes the decision of Step S44 like before and returns to Step S4, at which it continues the operation for detecting the trouble.

If both the answers of decisions of Steps S2 and S3 are NO so that neither the jamming of the paper currency nor the trouble of any sensor is detected, and if a trouble, if any, is recovered by the self recovering function or by the recovery work by the operator, the CPU resets, as a next trouble shooting operation, the value of a counter to be counted up by the output coming from the rotation detector 18 thereby to drive the DC motor M1 for a predetermined time period, and reads the value of the counter (at Step S4) after lapse of a predetermined time period and stores it for a while. It is then decided (at Step S5) whether or not the counted value is within a predetermined allowable range, that is, whether or not the run of the timing belts 14 constituting the paper currency transfer means is maintained at a proper velocity. If the answer reveals that the counted value deviates the allowable range, the CPU decides that the transfer velocity is so improper that some trouble has occurred, and interrupts all the operations by stopping the DC motor M1 after it has outputted an alarm indicating that a trouble is found. If, on the other hand, the counted value for the predetermined time period is within the allowable range, the CPU decides that the proper paper currency transfer velocity is retained, and resets the power ON flag (at Step S6) to store the end of the troubleshooting operation. Then, the CPU comes into the standby state in which the insertion of paper currency by a user is awaited (at Steps S7 to S10).

The CPU thus having entered into the standby state awaiting the insertion of paper currency decides at first whether or not the transfer position detecting sensor P2 is ON (at Step S7). If the answer is NO, the CPU further decides whether or not the passage detecting sensor P3 is ON (at Step S8). If this answer is also NO, the CPU detects (at Step S9) whether or not there is a reception inhibiting signal to be inputted thereto from an automatic vendor or a game machine by the time the various sales conducts and so on started with the paper currency insertion of one time are ended.

Figure 8:
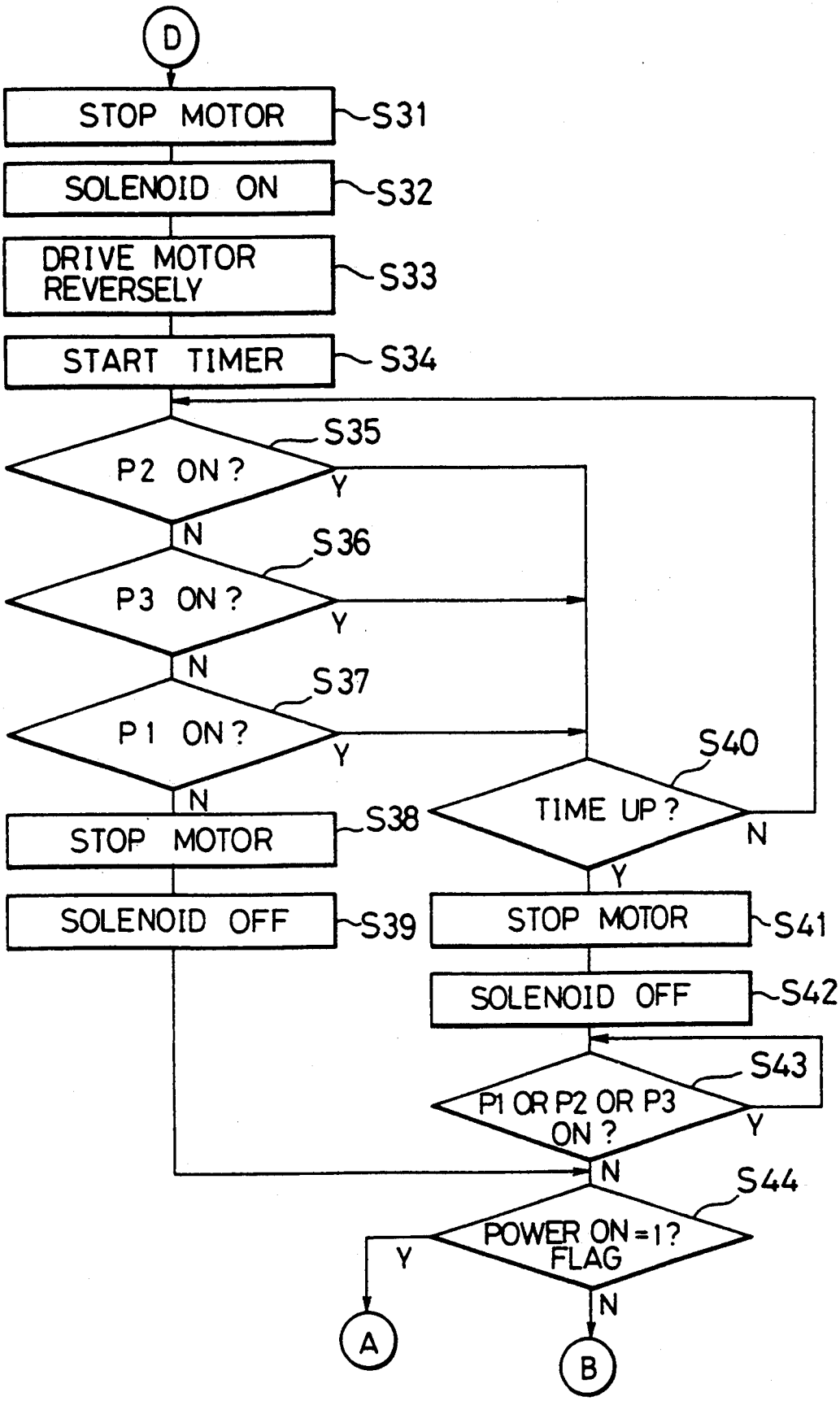
FIG. 8 is a continuation of the flow chart schematically showing the control program.

The operation of Step S7 to detect the ON/OFF state of the transfer position detecting sensor P2 and the operation of Step S8 to detect the ON/OFF state of the passage detecting sensor P3 are intended in this case to decide whether or not the sensors are troubled during the normal run after the power supply. If the answer of decision of Step S7 or S8 is YES, it is deemed that those sensors have exhibited abnormal responses notwithstanding that no paper currency was actually inserted, and the CPU executes the trouble recovering operation, as shown in FIG. 8, as in the case of detecting a trouble at the time of power supply. Since the occurrence of a trouble in this case is not just after the power supply so that the power ON flag has already been reset by the operation of Step S6, the answer of decision of Step S4 after the trouble is recovered by the operator is NO. Thus, both the operations of Steps S4 and S5 for deciding the propriety of the running velocity of the timing belts 14 are omitted, and the CPU advances to the operation of Step S7 after the decision of Step S44 and instantly restores the standby state for awaiting the insertion of paper currency. Since the trouble for the timing belts 14 to have an abnormal running velocity scarcely occurs, it is sufficient that the operation for detecting such trouble is executed once at each power supply.

On the other hand, if the answer of decision of Step S9 is YES, that is, if the sales conducts based upon the paper currency inserted before are not ended yet, only the decisions of Steps S7 to S9 are repeated in the aforementioned standby process while leaving the operation to detect the new insertion of paper currency by the paper currency insertion sensor P1 unexecuted.

Moreover, if both the transfer position detecting sensor P2 and the passage detecting sensor P3 are troubleless and if the previous sales conducts are ended, all the answers of decisions of Steps S7 to S9 are NO. Then, the CPU repeats the decisions of Steps S7 to S10 and detects at each cycle of this loop whether or not the paper currency insertion sensor P1 is ON (at Step S10), that is, whether or not the paper currency is newly inserted.

If the user inserts the paper currency into the paper currency discriminating device 1 while the CPU is repeating the decisions of Steps S7 to S10, the CPU detects the insertion of the paper currency by the decision of Step S10 and energizes the solenoid 22 (at Step S11) to retract the shutter member 24 out of the paper currency transfer passage. After this, the CPU energizes the DC motor M1 to turn it forward (at Step S12, as indicated at timing "a" in FIGS. 9 to 12) thereby to start the automatic currency transfer by the timing belts 14.

Subsequently, the CPU decides whether or not the transfer position detecting sensor P2 is ON (at Step S13), that is, whether or not the leading end of the paper currency being transferred forward while being clamped under pressure by the timing belts 14 and the guide rollers 20 has reached the position where the transfer position detecting sensor P2 is arranged. If the leading end of the paper currency has failed to reach the position of the transfer position detecting sensor P2, the CPU is held in the standby state while repeating the decision of Step S13. Incidentally, there may take place the case in which the transfer position detecting sensor P2 is not turned ON even if five seconds or more have elapsed after the start of the automatic transfer of the paper currency by the timing belts 14, although not specifically shown in the flow charts. Then, the CPU skips to Step S31 and executes the aforementioned trouble recovery and paper currency return (as is termed as the returning operation) of Steps S31 to S44 to return the inserted paper currency until it returns again to the initial standby state of Steps S7 to S10.

When the leading end of the paper currency reaches to the position of the transfer position detecting sensor P2 so that the sensor P2 is turned ON, the CPU detects this at the decision of Step S13 and reset the value of the counter (at Step S14), which is to be counted up by the output coming from the rotation detector 18, thereby to deenergize the solenoid 22 (at Step S15, as indicated at timing "b" in FIGS. 9 to 12). Until the aforementioned counter value reaches such a set value corresponds to the transfer stroke of the paper currency as is required for reading the discrimination data, the CPU then repeats the operations of Steps S16 and S17 to continuously execute the reading of the magnetic data from the magnetic heads 21, the reading the optical transmittance data from the paper currency insertion sensor P1 and the transfer position detecting sensor P2, and the storing them in the RAM 47.

When the solenoid 22 is deenergized at Step S15, the shutter member 24 is protruded again into the paper currency transfer passage 6 by the biasing force of the coil spring 28. At this time, however, the leading end of the inserted paper currency passes over the position of the transfer position detecting sensor P2 at the back of the shutter member 24 so that the leading end of the shutter member 24 is supported by the paper currency face and blocked from entering the hole 30 of the lower transfer plate 4. Thus, the paper transfer passage 6 is not completely closed so that the paper currency being transferred by the timing belts 14 is moved as it is while having its upper face rubbed by the leading end of the shutter member 24. In this meanwhile, the paper currency is transferred by the timing belts 14, as the DC motor M1 rotates forward, and is gradually moved toward the downstream of the transfer passage. When the leading end comes out of the exit of the paper currency transfer passage 6, it pushes up the leading end of the extraction preventing lever 33 against the biasing force of the coil spring 34. As a result, the lever 33 rocks counter-clockwise of FIGS. 1 to 3 so that the passage detecting sensor P3 issues an ON output (as indicated at timing "c" in FIGS. 9 to 12).

The upper end of the impeller 10 is slightly higher by the gap B than the transfer face of the paper currency transfer passage 6, as located in FIG. 3, so that the leading end of the paper currency projected from the paper currency transfer passage 6 will interfere temporarily with the vanes of the impeller 10. Despite of this interference, however, the impeller 10 is rotating in the currency transferring direction in association with the DC motor M1 driving the timing belts 14, and its circumferential velocity is higher than the transfer velocity of the timing belts 14 so that no jamming with the paper currency will occur. Thus, the paper currency has its leading end fed into the paper currency discriminating device 1 while sneaking through the clearance between the impeller 10 and the projection 9 (as indicated by dotted lines in FIG. 3).

When the paper currency being transferred is further moved so far as its trailing end passes the position of the shutter member 24, the leading end of the shutter member 24 has no sliding contact with the paper currency being transferred. As a result, the leading end of the shutter member 24 is forced into the hole 30 of the lower transfer plate 4 by the biasing force of the coil spring 28 so that the paper currency transfer passage 6 is completely closed just upstream of the magnetic heads 21 and the transfer position detecting sensor P2.

Figure 9:
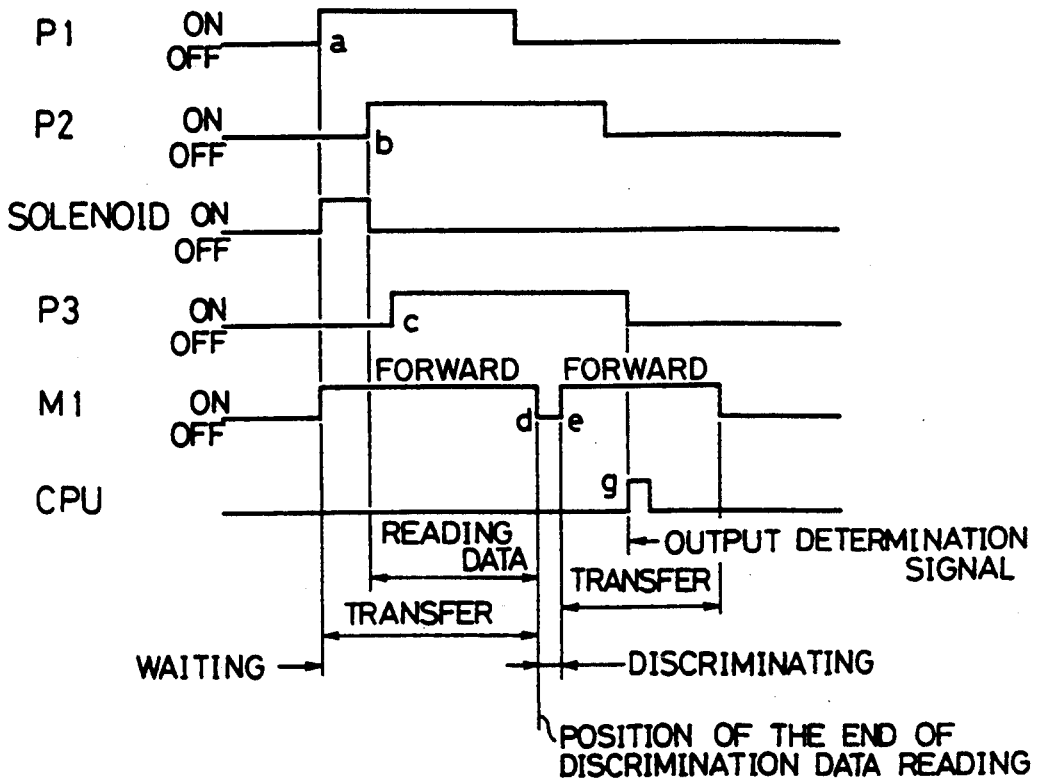
FIG. 9 is a timing chart showing one example of the operating status of the paper currency discrimination device of the same embodiment (in case a single sheet of paper currency is inserted)

Moreover, that set value corresponding to the transfer stroke of the paper currency, which is required for reading the discrimination data, is reached by the aforementioned counter value, and the trailing end of the paper currency passes over the position of the magnetic heads 21 and arrives at the position of the end of the discrimination data reading. Then, the CPU detects this arrival by the decision of Step S17 and stops the drive of the DC motor M1 to interrupt the transfer of the paper currency by the timing belts 14 (at Step S18, as indicated at timing "d" in FIGS. 9 to 12). Since the arrival of the trailing end of the inserted paper currency at the discrimination data reading ending position implies that the trailing end of the inserted paper currency passes over the position of the insertion detecting sensor P1, this sensor P1 should have naturally been turned OFF at this stage (in case of the troubleless transfer, as shown in FIG. 9 or 11), unless a continuous insertion of paper currency is executed.

Therefore, the CPU decides whether or not the insertion detecting sensor P1 is OFF (at Step S19). The ON state of the insertion detecting sensor P1 at this time means the execution of such remarkably close continuous insertions as might invite an overlap between the trailing end of the first paper currency and the leading end of the second paper currency inserted. Especially in this overlap case, even if the solenoid 22 is deenergized at Step S15 to protrude the shutter member 24 into the paper currency transfer passage 6, the leading end of the shutter member 24 is blocked from entering into the hole 30 of the lower transfer passage 4 by the succeeding paper currency so that the invasion of the second paper currency cannot be prevented.

Figure 10:
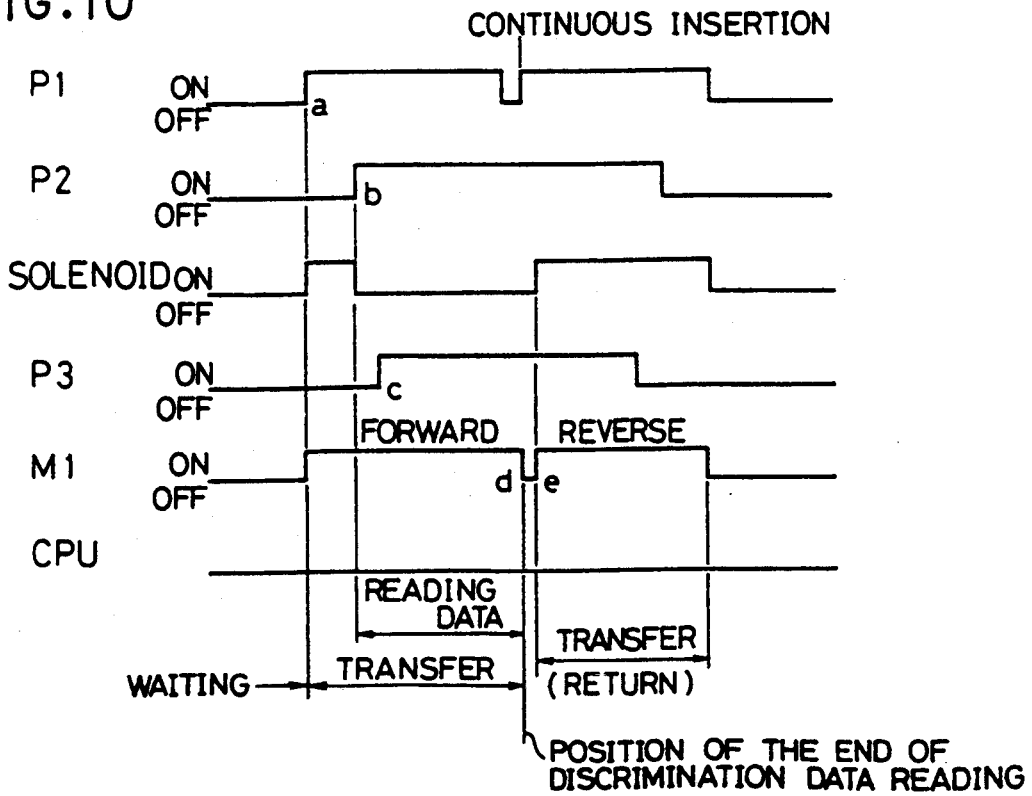
FIG. 10 is a timing chart showing one example of the operating status of the paper currency discrimination device of the same embodiment (in case sheets of unacceptable paper currency are continuously inserted)
Figure 11:
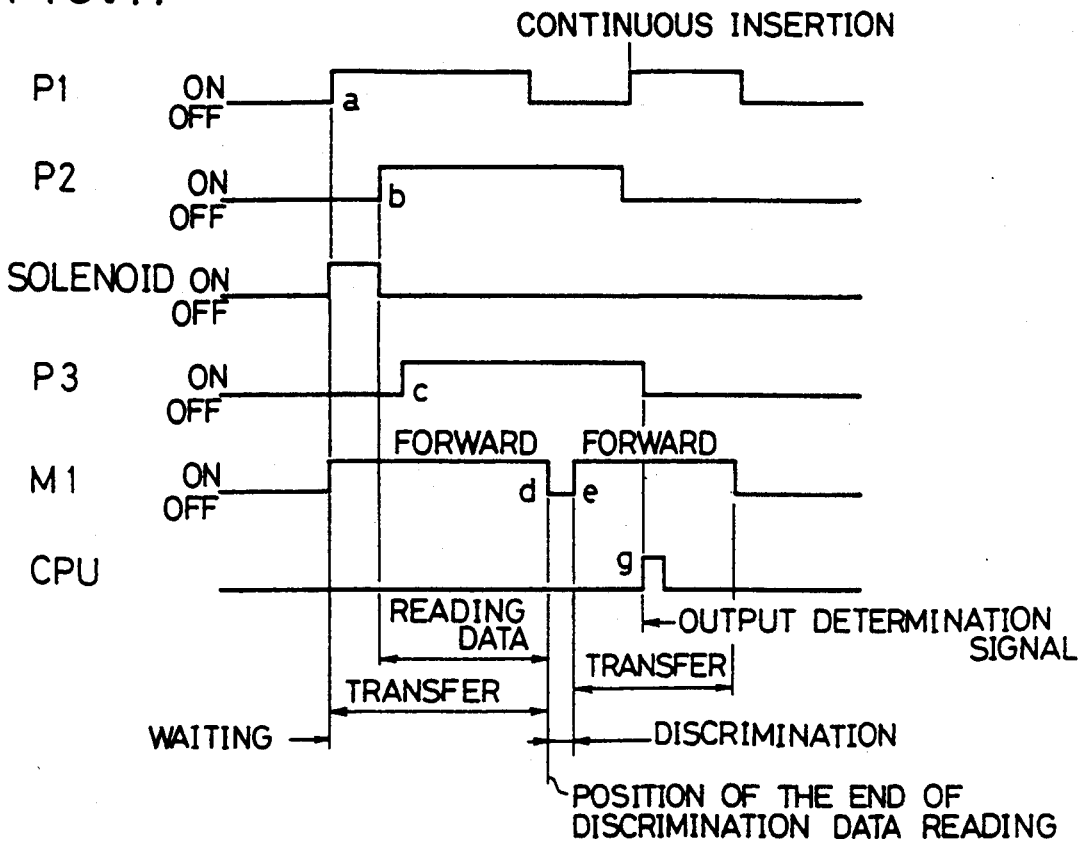
FIG. 11 is a timing chart showing one example of the operating status of the paper currency discrimination device of the same embodiment (in case sheets of acceptable paper currency are continuously inserted)

Therefore, if the answer of decision of Step S19, as exemplified in case of the remarkably close continuous insertions, as shown in the timing chart of FIG. 10, or in case of the aforementioned abnormal continuous insertions having an overlap between the trailing end of the first paper currency and the leading end of the second paper currency, the CPU is made to execute the operation of returning all the sheets of paper currency inserted. One reason is that the jamming might occur if double insertions of paper currency should be allowed although the second sheet is genuine. Another reason is that such abnormal insertion is scarcely caused in the ordinary operations so that the second sheet might possibly be considered to be not a genuine one but a plastic chip or the like for illegal operations.

The CPU thus having transferred to the operation of Step S31 then executes the aforementioned trouble recovery and return (as is termed as the returning operation) of Steps S31 to S44 to return all the sheets of paper currency inserted, and restores the initial standby state (although the return is started at timing "e" in FIG. 10) composed of the operations of Steps S7 to S10.

Figure 12:
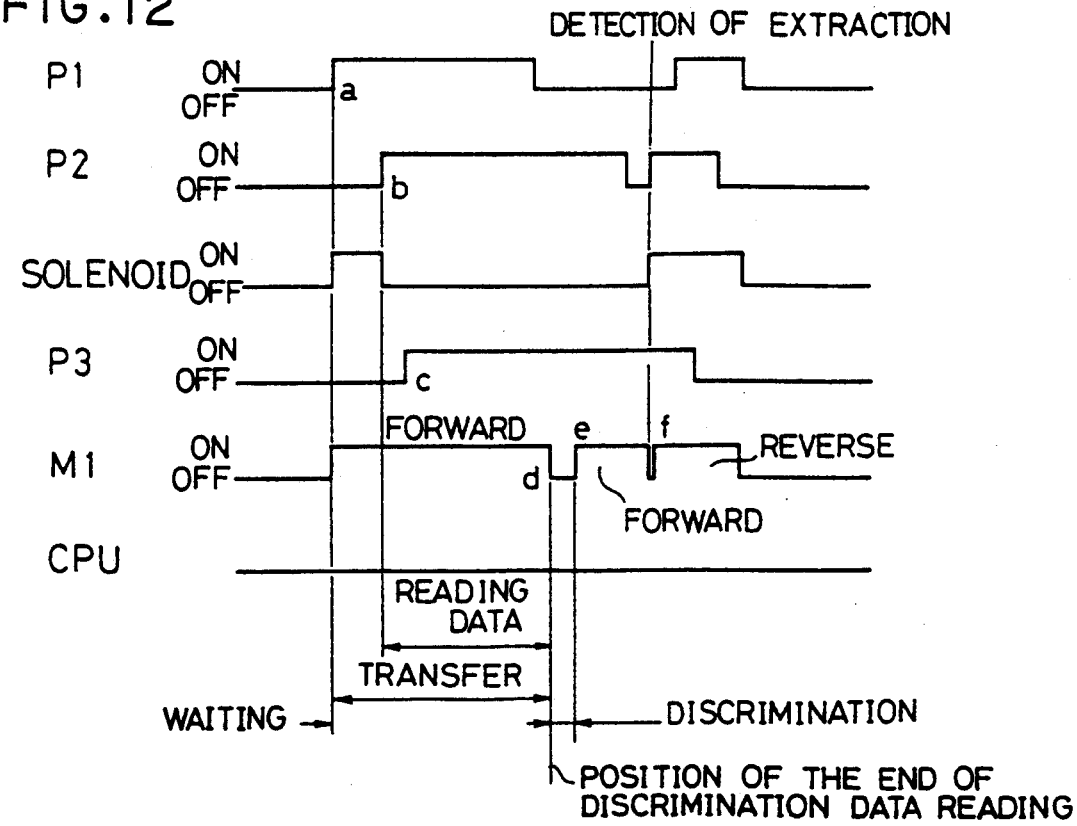
FIG. 12 is a timing chart showing one example of the operating status of the paper currency discrimination device of the same embodiment (in case an extraction occurs due to illegal operations)

On the other hand, if the answer of decision of Step S19 is NO, that is, if the paper currency insertion sensor P1 is OFF at the stage when the trailing end of the inserted paper currency being processed reaches the discrimination data reading end position, it can be decided (as shown in FIGS. 9, 11 and 12) that neither the unreasonably continuous insertions nor the apparently illegal operations are executed at least at this stage. Therefore, the CPU advances to Step S20, at which it compares the discrimination data of the inserted paper currency, as stored in the RAM 47, and the normal reference data of the ROM 46 (at timings, as indicated at "d" and "e" in FIGS. 9, 11 and 12). If this decision answers that the paper currency is not genuine (at Step S21), the CPU executes the operations relating to the returns of Steps S31 to S44 like before, to return the abnormal paper currency to the user. After this, the CPU restores again the standby state composed of the operations of Steps S7 to S10.

If, on the contrary, it is confirmed that the answer of decision of Step S21 is that the paper currency inserted at this time is genuine, the CPU starts the forward rotation of the DC motor M1, while holding the output of its decision answer in suspension, to reopen the forward transfer of the paper currency by the timing belts 14 (at Step S22, as indicated at timing "e" in FIGS. 9, 11 and 12). The CPU thus having started the forward rotation of the DC motor M1 then decides whether or not the transfer position detecting sensor P2 is ON (at Step S23), that is, whether or not the trailing end of the normal paper currency having been temporarily stopped at the discrimination data reading ending position has been caused to pass over the position of the transfer position detecting sensor P2 by reopening the forward transfer. If the trailing end of the paper currency has not passed over the position of the sensor P2 yet, the CPU drives the DC motor M1, as it is, and awaits the passage of the paper currency. Moreover, if it is detected by the decision of Step S23 either that the trailing end of the genuine money inserted has passed over the position of the transfer position detecting sensor P2 or that the leading end of the genuine money is moved upstream of the transfer passage by the illegal extraction using a transparent plastic chip or a thread to turn OFF the transfer position detecting sensor P2, the CPU decides whether or not the passage detecting sensor P3 has been turned ON (at Step S24).

If the genuine money is being transferred forward according to the feed of the timing belts 14, it never happens that the passage detecting sensor P3 is turned OFF as a result that the trailing end of the genuine money inserted passes over the position of the extraction preventing lever 33 immediately after it has passed over the position of the transfer position detecting sensor P2 (as shown in FIG. 9). In case, however, the leading end of the genuine money should be moved upstream of the transfer passage by the aforementioned illegal extraction or the like, it could happen that both the transfer position detecting sensor P2 and the passage detecting sensor P3 should be turned OFF at the time of executing the decision of Step S24.

If, therefore, the answer "NO" of the decision of Step S24 detects the illegal extraction, the CPU inhibits its decision signal output held in suspension, to stop the DC motor M1 (at Step S30) and restores again the initial standby state composed of the operations of Steps S7 to S10. In this case, both the transfer position detecting sensor P2 and the passage detecting sensor P3 are OFF, and the output of the decision signal is inhibited, so that neither sales conducts are being performed nor is detected the reception receiving signal from the automatic vendor or the game machine. Hence, all the answers of decisions of Steps S7 to S9 are NO. Thus, if the illegal extraction is completely ended to turn OFF the insertion detecting sensor P1 at the instant when the operations of the CPU restores the initial standby state, more strictly, when the decision of Step S10 after the restoration is executed for the first time, the CPU repeats the standby operations of Steps S7 to S10 to await the new insertion of paper currency. On the other hand, if the extraction is not ended so that the insertion detecting sensor P1 is turned ON, this paper currency is inserted again to start operations similar to the aforementioned ones.

On the other hand, if the passage detecting sensor P3 is ON to give the answer "YES" to the decision of Step S24, that is, if it is confirmed that the trailing end of the paper currency being transferred is positioned between the transfer position detecting sensor P2 and the extraction preventing lever 33, it implies that any illegal extraction is not made at least at this stage, and the CPU energizes the DC motor M1 to continue the forward transfer of the paper currency by the timing belts 14. Then, the CPU decides whether or not the transfer position detecting sensor P2 having been turned OFF at the time of executing the decision of Step S23 has been turned ON again (at Step S25), that is, whether or not an illegal return is being made upon the paper currency having passed even at its trailing end over the position of the transfer position detecting sensor P2. Unless the transfer position detecting sensor P2 is ON, it is decided (at Step S26) whether or not the passage detecting sensor P3 is ON (at Step S26), that is, whether or not the trailing end of the paper currency to be transferred has passed over the position of the extraction preventing lever 33 so that the introduction of the paper currency has been ended.

After this, the CPU repeats the decisions of Steps S25 to S26 like before till the transfer position detecting sensor P2 is turned ON to give the answer "YES" to the decision of Step S25 or if the passage detecting sensor P3 is turned OFF to give the answer "NO" to the decision of Step S26.

Here, for example, if the transfer position detecting sensor P2 is turned ON again while the passage detecting sensor P3 is ON, that is, if the answer of decision of Step S25 is YES, it implies that an illegal extraction is made upon the paper currency being transferred. Therefore, the CPU stops the DC motor M1 (at Step S30) and then skips again to Step S7 to restore the initial standby state. Since, in this time, the transfer position detecting sensor P2 is held ON, the CPU returns to the operation of Step S31 from the decision of Step S7, to execute the returning operations of the paper currency (such returning operation is started at timing "f", as shown in FIG. 12).

If the trailing end of the paper currency is introduced over the position of the extraction preventing lever 33 without the transfer position detecting sensor P2 being turned ON again, as shown in FIG. 9, that is, if the answer of decision of Step S26 is NO, it can be deemed that the normal introduction is carried out. Therefore, the CPU resets the value of the clock counter (at Step S27), which is to be counted up in response to the output of the rotation detector 18, and outputs the result of decision and kind of the paper currency, which has been temporarily stored in the RAM 47, to the automatic vendor or the game machine (at Step S28, as indicated by timing "g" in FIG. 9).

If no paper currency additionally inserted is detected till the trailing end of the paper currency reaches the discrimination data reading ending position to stop the drive of the DC motor M1 temporarily so that the aforementioned decision of Step S19 gives the answer "YES" but is followed by a continuous insertion, that is, if the paper currency is additionally inserted once the drive of the DC motor M1 is temporarily stopped, as shown in FIG. 11, it implies that the trailing end of the first paper currency and the leading end of the second paper currency were so separated that the invasion of the second paper currency could be sufficiently blocked by the closing action of the shutter member 24 at Step S15. In this case, too, the result of decision and the kind of the first paper currency are outputted at timing "g" of FIG. 11 by the aforementioned operation of Step S28.

Incidentally, after the decision of Step S19 has given the answer "YES", no operation is executed for detecting the operating state of the insertion detecting sensor P1. As a result, no difference exists in the operation between the case in which only one sheet of paper currency is inserted (as shown in FIG. 9) and the case in which another paper currency is additionally inserted once the drive of the DC motor M1 is temporarily stopped,(as shown in FIG. 11).

In the case of additional insertion of paper currency after the temporary stop of the drive of the DC motor M1, the second paper currency is inhibited from invading into the paper currency passage 6 over the magnetic heads 21 by the closing function of the shutter member 24, so that it is held immediately upstream of the shutter member 24 till the procedure for the first paper currency is ended. If, however, the first paper currency is returned as a result that it was found counterfeit or that its extraction was detected, the second paper currency is returned together with the first one by that returning operation.

After having outputted the decision result and kind of the paper currency to the automatic vendor or the game machine, the CPU reads the present value of the counter and decides whether or not the read value has reached that set value corresponding to the rotation of the impeller 10 (at Step S29), which is required for ending the introduction of the paper currency.

If the answer is NO, the CPU energizes the DC motor M1 to rotate the impeller 10 till the set value is reached by the value of the counter. Before long the paper currency has its trailing end brought out of engagement with the impeller 10 until it is taken up by the stacker or the like (not shown). If the answer of decision of Step S29 is YES so that the end of introduction of the paper currency is confirmed, the CPU stops energization of the DC motor M1 (at Step 30) to stop the feed of the timing belts 14 and the impeller 10. Thus, the CPU ends all the operations relating to the paper currency inserted at this time and restores the initial standby state composed of Steps S7 to S10. Incidentally, if the succeeding paper currency is held in suspension just upstream of the shutter member 24 by the proper continuous insertions, the insertion detecting sensor P1 is already ON at this stage so that the operations on and after Step S11 are instantly started unless the signal itself to inhibit reception from the automatic vendor or the game machine is detected.

The paper currency thus having passed over the upper outer circumference of the impeller 10 and taken into the stacker or the like falls due its own weight. Therefore, if a thread or the like is attached to the paper currency, it is caught by the shaft 12 of the impeller 10 to suspend the paper currency in the air. Incidentally, the impeller 10 is made so thin, as shown in FIG. 2, that the thread will not depend eventually along the outer circumference of the impeller 10. If, in this state, the thread is pulled to extract the paper currency, the paper currency is pulled vertically upward by the thread until its end portion is caught by the vanes which are located at the lower portion of the impeller 10. At the end of the introduction, moreover, the impeller 10 has s topped its rotation, and a braking force is applied to the rotation of the impeller by the reduction mechanism in the gear casing 16 (as the gear casing 16 of the embodiment uses the worm-wheel mechanism which is irreversely rotational in the power transmitting direction) so that the impeller 10 is not turned backward. Thus, if the extraction is enforced in this state, the thread is cut by the excessive tension so that the paper currency is recovered as it is by the stacker or the like.

On the other hand, if an illegal person intending an illegal recover by suspending the paper currency with a thread tries to extract the paper currency while detecting the tension of the thread at his fingertip, it is possible to detect the instant when the tension acting upon the thread is weakened by the drop of the transfer force, i.e., the instant when the trailing end of the paper currency is sent out from the exit of the paper currency transfer passage 6 to the vicinity of the gap B, as shown in FIG. 3, between the projection 9 and the impeller 10, that is, the instant immediately before the trailing end of the paper currency is trapped by the impeller 10.

At this instant, however, the extraction preventing lever 33 having been raised by the trailing end of the paper currency has rocked to the position, as indicated by double-dotted lines in FIG. 3, so that the ON state of the passage detecting sensor P3 is held to output no decision signal concerning the paper currency. As a result, even if the extraction could be made in that state, no substantially illegal conduct can be made on the paper currency so long as no decision signal is outputted. This operation is such an illegal one that the transfer position detecting sensor P2 is turned ON again with the passage detecting sensor P3 being ON after it has been once turned OFF. This illegal operation is detected through the routine of Steps S23 to S26 by the CPU of the paper currency discriminating device 1.

Immediately after the trailing end of the paper currency passed through the gap B between the projection 9 and the impeller 10 so that the passage detecting sensor P3 was turned OFF and before the thread or the like attached to the paper currency comes onto the shaft 12, it is mechanically difficult to extract the paper currency with that thread. The OFF state of the passage detecting sensor P3 implies that the trailing end of the paper currency has completely passed through the gap B of FIG. 3 and come over the impeller 10. Since the upper end of the impeller 10 is positioned over the paper transfer face of the paper currency transfer passage 6, the trailing end of the paper currency is brought, when the thread or the like is pulled in this state, into interference with the projection 9 so that it is raised along the tapered upper face of the projection 9. If, in this state, the thread is forcibly pulled, it is detached from the paper currency which has its rear end held by the end portion of the upper transfer plate 3, so that the paper currency is recovered by the stacker or the like. If, at this time, the thread attached to the paper currency is positioned within the range of the width of the projection 9, as shown in FIG. 2, it is theoretically possible to move the trailing end of the paper currency, which is being guided by the thread pulled back along the lower face of the projection 9, backward to the gap B between the projection 9 and the impeller 10. Despite of this theoretical possibility, however, it is almost impossible to move the paper currency backward over the extraction preventing lever 33 because the paper currency transfer passage 6 has its exit closed by the extraction preventing lever 33.

In one embodiment of the present invention thus far described, at the time of introducing the paper currency, the impeller 10 is positively rotated in the paper currency transferring direction to ensure the introduction of the paper currency which has its trailing end transferred to the exit of the paper currency transfer passage 6. Despite of this description, however, the impeller 10 need not always be positively rotated unless there is a fear that the vicinity of the gap B is clogged with the paper currency, the trailing end of which has left the paper currency transfer passage 6 (i.e., which has quitted to receive the transferring force from the timing belts 14), by the pressure or the like of the extraction preventing lever 33. For example, the construction may be modified such that the two timing belts 14 are made to run between the pulleys 7 and 8 to make the impeller 10 independent of the paper currency transfer means so that they can be rotated only in the paper currency transferring direction through a one-way clutch or the like. In this case, at the time of the forward transfer of the paper currency, the impeller 10 is rotated forward by having its vane pushed by the leading end of the paper currency. However, the backward rotation of the impeller 10 is completely inhibited so that the illegal extraction of the paper currency is inhibited like before. Incidentally, in the state where the paper currency has its face contacting with the outer circumference of the impeller 10, namely, in the state the paper currency does not have its trailing end held between the vanes of the impeller 10, the returning operation by the paper currency discriminating device 1 can be accomplished without any trouble because the paper currency can be moved backward while establishing a slippage between its face and the impeller 10.

According to the embodiment thus far described, when the paper currency insertion sensor detects the insertion of paper currency, the paper currency transfer means is driven to start the transfer of paper currency along the direction of insertion, and the impeller associated with the drive source of the paper currency transfer means rotates in the paper currency transferring direction so that the information detecting means detects the information for discriminating the paper currency in the course of transfer of the paper currency. The inserted paper currency is transferred by the paper currency transfer means and passes through the gap between the upper side of the impeller rotating in the paper currency transferring direction and the edge of the transfer plate until it is recovered by the paper currency discriminating device. In case, on the other hand, the impeller rotating only in the paper currency transferring direction is made independent of the drive source of the paper currency transfer means, the leading end of the paper currency being transferred along the direction of insertion by the paper currency transfer means pushes the impeller to forcibly rotate it in the paper currency transferring direction so that the paper currency passes through the gap between the impeller rotating in the paper currency transferring direction and the edge of the upper transfer plate until it is recovered by the paper currency discriminating device.

At the end of the transfer of the paper currency, the drive of the paper currency transfer means is stopped, and the rotation of the impeller associated with the drive source of the transfer means is also stopped. The passage detecting sensor allows, after it has detected the passage of the paper currency through the impeller, the output of the paper currency deciding signal based on the discrimination information read by the information detecting means. If the paper currency is to be extracted by pulling the thread or tape attached thereto after it has passed over the impeller, its end is caught by either the vane of the irreversely rotational impeller or the projection formed at the edge of the upper transfer plate, so that its extraction cannot be performed. As a result, the thread or tape attached to the paper currency is cut by the forcible extraction so that the paper currency freed from the thread or tape is recovered by the paper currency discriminating device. More-over, the passage detecting sensor constructed of the extraction preventing lever, which is made rockable and protruded downward slightly over the paper currency transfer face of the lower transfer plate, closes the paper currency transfer passage, as the paper currency passes, to prevent the extraction of the paper currency together with the impeller and the projection of the transfer plate.

If the paper currency is illegally extracted by pulling the thread or tape at the stage before it passes over the impeller, the passage detecting sensor is left inoperative to inhibit the paper currency deciding signal so that the discrimination information detected by the paper currency is invalidated. Moreover, after the insertion of the paper currency and before the recovery of the paper currency is detected by the action of the passage detecting sensor, an additional insertion of new paper currency is inhibited by the shutter which has its actuation controlled by the shutter control means, so that the extraction of the paper currency by the illegal operation to open the shutter is prevented.

Although the foregoing description is directed to the embodiment of the paper currency discriminating device 1 using the impeller 10 and the projection 9, here will be described another embodiment of the paper currency discriminating device with reference to FIGS. 13 to 15. In this embodiment, the return of paper currency is prevented by replacing the impeller 10 and the projection 9 of the paper currency discriminating device 1 of the foregoing embodiment by forced transfer means 51 and a projection 52, and the detection of the illegal operation relating to the return of paper currency is ensured by providing an extraction preventing lever 53. Incidentally, a paper currency discriminating device 50 according to this embodiment has an entire construction similar in many portions to that of the foregoing paper currency discriminating device 1. Therefore, the description of the portions having the identical constructions will be omitted by designating them at the common reference numerals used in connected with FIGS. 1 to 3. The description to be made in the following is directed mainly to the differences in the constructions.

Figure 13:
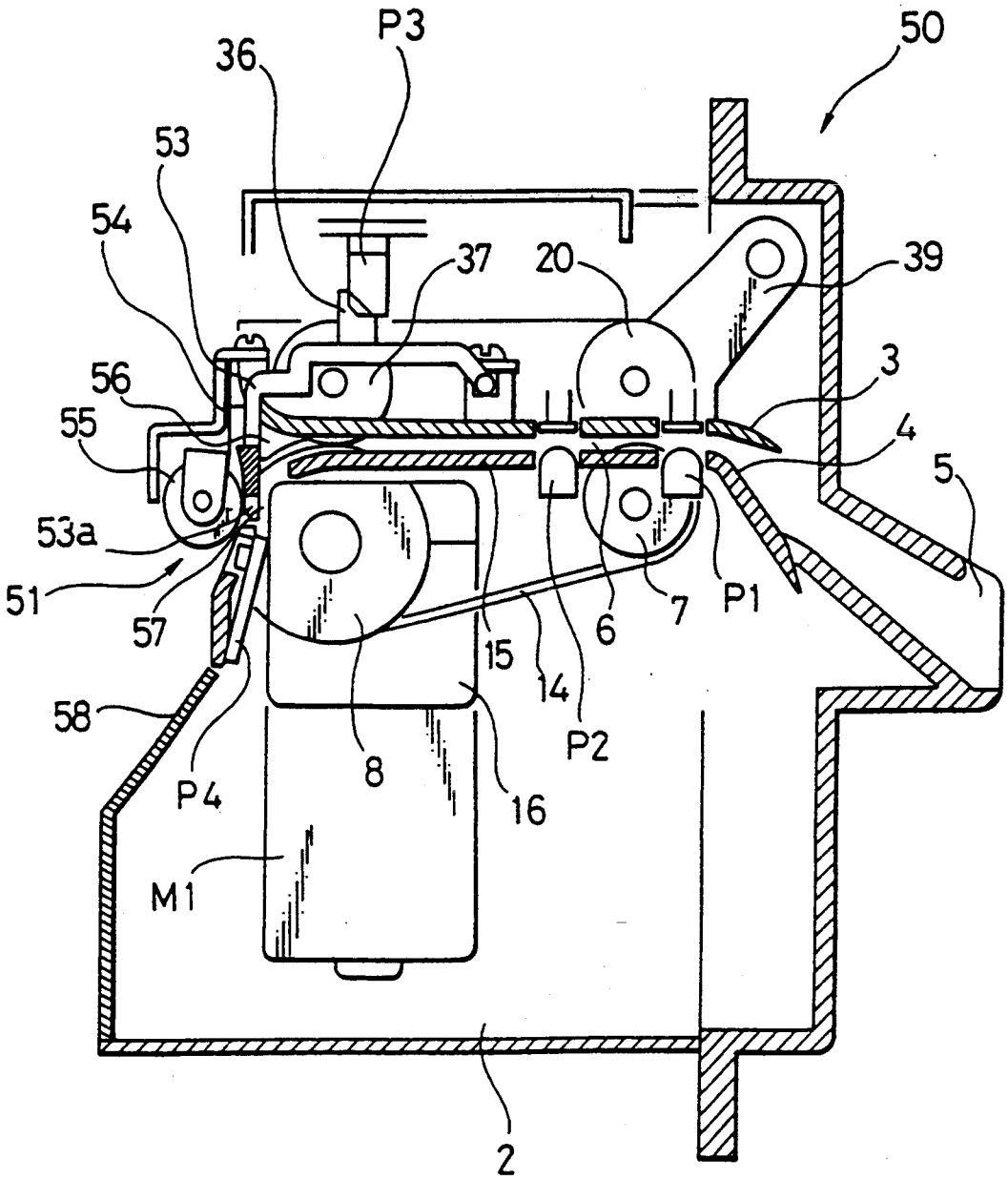
FIG. 13 is a sectional side elevation showing an essential portion of a paper currency discriminating device according to another embodiment of the present invention.
Figure 14:
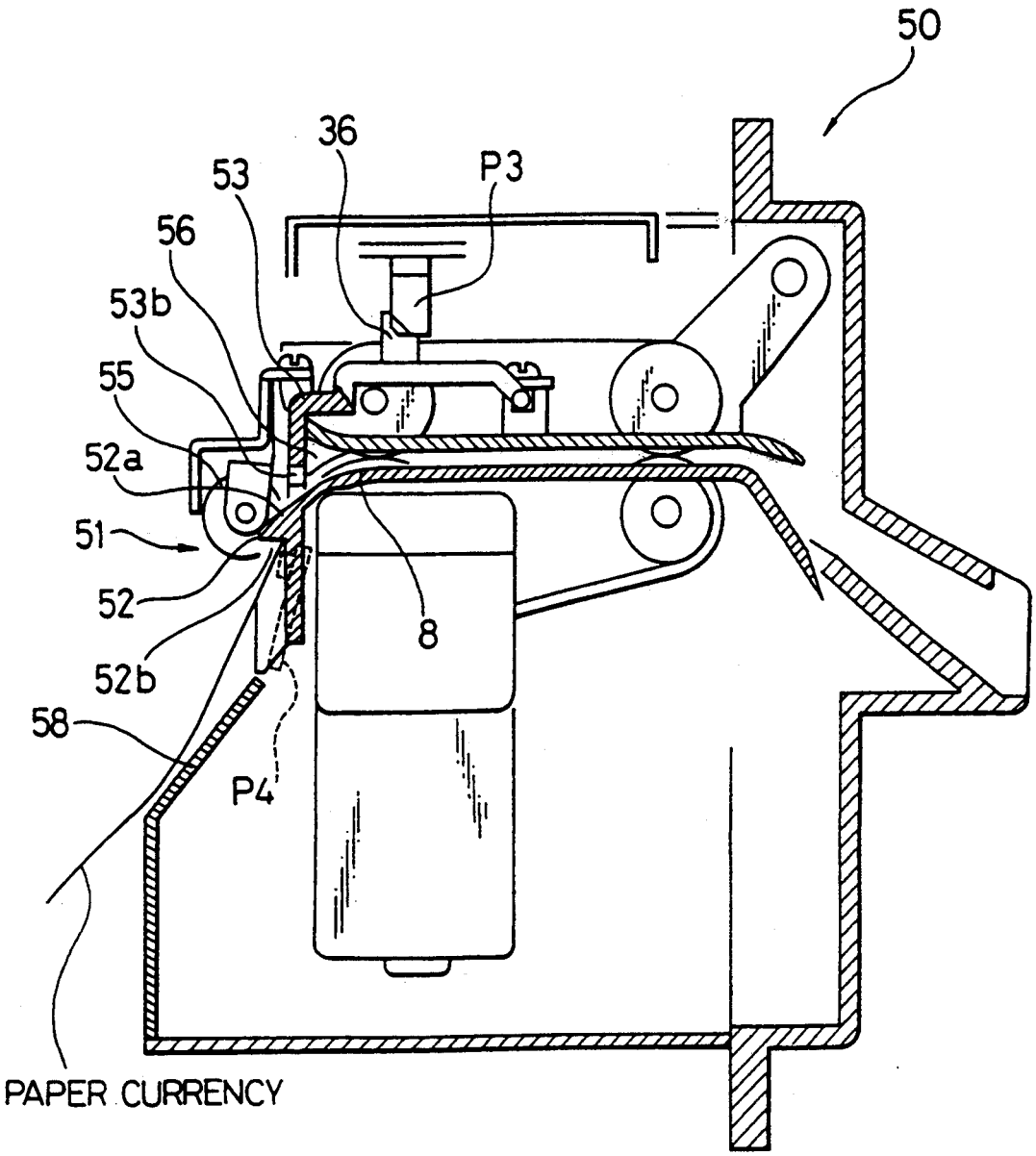
FIG. 14 is a sectional side elevation showing another essential portion of a paper currency discriminating device according to the same embodiment.

FIG. 13 is a sectional side elevation showing an essential portion of the construction of the paper currency discriminating device 50, and FIG. 14 is also a sectional side elevation showing the essential portion by halving the paper currency discriminating device 50.

The forced transfer means 51 is constructed to include: the timing belts 14 which are made to run on the drive timing pulleys 8; and a pinch roller 55 which is disposed to correspond to the position of the drive timing pulleys 8 and which is urged onto the drive timing pulleys 8 by the action of a leaf spring 54 fixed on the upper transfer plate 3. The forced transfer means 51 thus constructed is positioned outside of the exit end of the paper transfer passage 6.

Moreover, the upper transfer plate 3 has its exit end lower face formed with a wedge-shaped course regulating member which has a generally arcuate sliding face formed along the outer circumference of the drive timing pulleys 8 to be rotated by the timing belts 14. Thus, the course regulating member 56 bends down the leading end of the paper currency, which is fed from the paper currency transfer passage 6, to hold it between the timing belts 14 running on the drive timing pulleys 8 and the pinch roller 55.

Moreover, the lower transfer plate 4 is formed at its exit end with a slit 57 which is extended throughout the width of the paper currency transfer passage 6. On the other hand, the extraction preventing lever 53 has its base end hinged rockably to the upper trans-fer plate 3 such that its leading end 53*a* faces the gap between the exit end of the paper currency transfer passage 6 and the forced transfer means 51. This extraction preventing lever 53 has its leading end protruded by its own weight to the lower transfer place 4 over the paper currency transfer face of the forced transfer means 51, i.e., the external contours of the timing belts 14 made to run on the timing pulleys 8. This extraction preventing lever 53 is made as wide (i.e., in the direction of inside from the front in FIG. 13) at least at its leading end 53*a* as the width of the paper currency.

On the other hand, the lower transfer plate 4 is formed, at a position close to the position of the slit 57, with the projection 52 which is so formed at a central portion in the widthwise direction of the paper currency as to slightly exceed the paper currency transfer face of the forcible transfer means 51, i.e., the external contours of the timing belts 14 made to run on the timing pulleys 8. Correspondingly, the extraction preventing lever 53 is formed, at the widthwise central portion of its leading end 53*a*, with a notch 53*b* for avoiding the interference with the projection 52, so that its leading end 53*a* can enter the side of the lower transfer plate 4 over the paper transfer face of the forced transfer means 51. In other words, the leading end 53*a* of the extraction preventing lever 53 enters the slit 57 of the lower transfer plate 4 across the projection 52, which is projected from the side of the lower transfer plate 4 over the paper currency transfer face of the forced transfer means 51, and over the projection 52 and the paper currency transfer face in the forced transfer means 51.

As shown in FIG. 14, the projection 52 has its upper slope 52*a* so projected from the paper currency transfer face of the forcible transfer means 51 as to rise from the inner side of the outer contours of the timing belts 14 running on the timing pulleys 8 and to extend at a gentle angle with respect to the transfer direction of the paper currency along the tangential lines to the outer circumferences of the timing pulleys 8 in its rising position. As a result, the paper currency fed out from the paper currency transfer passage 6 is easily enabled to ride over the projection 52 by having its central portion warped in its width direction and can be transferred while being held by the forced transfer means 51. The contacting faces between the pinch roller 55 and the timing belts 14 in the forced transfer means 51 are substantially located downstream of the position of the projection 52 in the transfer passage, that is, at the side of a paper currency recovery chute 58 which is formed of the outer slope of the casing 2 of the paper currency discriminating device 50. Thus, the forcible transfer means 51 can discharge the paper currency reliably to the side of the paper currency recovery chute 58 even if a frictional resistance acts between the upper slope 52*a* of the projection 52 and the paper currency.

On the other hand, the projection 52 has its lower face 52*b* formed to intersect the moving passage of the paper currency, which is to be recovered along the paper currency recovery chute 58, at such an acute angle that the paper currency having been once recovered across the projection 52 by the paper currency recover chute 58 is seriously difficult to move backward. Over the paper currency recovery chute 58 at one side of the paper currency widt direction (i.e., inside from the front direction in FIG. 13), moreover, there is arranged in the vicinity of the forced transfer means 51 a paper currency introduction conforming sensor P4 for confirming the feed of the paper currency to the stacker which is connected to the downstream side of the paper currency recovery chute 58.

Although not shown in FIG. 13 and later Figures, the paper currency discriminating device 50 is equipped, like the paper currency discriminating device of the foregoing embodiment, with the individual members such as the shutter member 24, the solenoid 22, the magnetic heads 21, the perforated disc 17, the rotation detector 18, the paper currency insertion sensor P1, the transfer position detecting sensor P2 and the passage detecting sensor P3. And, the constructions relating to their arrangement and functions and the control means are similar to those of FIG. 4. The paper currency introduction confirming sensor P4 is connected like the passage detecting sensor P3 with the drive controlling microprocessor.

Therefore, the control program used in the drive control of the paper currency discriminating device 50 can also employ that of the embodiment shown in FIGS. 5 to 8. In case, moreover, the genuineness/counterfeitness decision result of the paper currency is to be outputted after the introduction of the paper currency has been confirmed by the paper currency instruction confirming sensor P4, there are inserted between the operation of Step S26 and the operation of Step S27 of FIG. 7: the operations for resetting and starting the trouble detecting timer; the deciding operations for confirming the ON/OFF states of the paper currency introduction confirming sensor P4; and the deciding operations for shifting the operations to the returning operations similar to those of the foregoing embodiment, if the trouble detecting timer counts a predetermined time period in case it is decided that the paper currency introduction confirming sensor P4 is ON and otherwise to the deciding operations for confirming the ON/OFF states of the paper currency introduction confirming sensor P4 again. After the answer of decision of Step S26 is NO, the procedure is shifted to Step S27 only if the paper currency introduction confirming sensor P4 is turned OFF within a predetermined time period. Here will be described the operations of the paper currency discriminating device 50, but the description of the overall processing operations will be omitted because they are similar to those of the case of the paper currency discriminating device 1. Thus, here will be stressed the portions which are different from those of the foregoing embodiment.

First of all, when the user inserts his paper currency, the paper currency insertion sensor P1 detects this insertion to open the shutter member 24 so that the DC motor M1 is rotated forward to start the automatic transfer of paper currency by the timing belts 14. In this timing, the driven rotation of the pinch roller 55 acting as the forced transfer means 51 is started. Moreover, when the leading end of the paper currency arrives at the position of the transfer position detecting sensor P2 so that the arrival is detected by the transfer position detecting sensor P2, the solenoid 22 is deenergized as in the foregoing embodiment, and the reading operations of the paper currency data by the paper currency insertion sensor P1, the transfer position detecting sensor P2 and the magnetic heads 21 are started.

Figure 15:
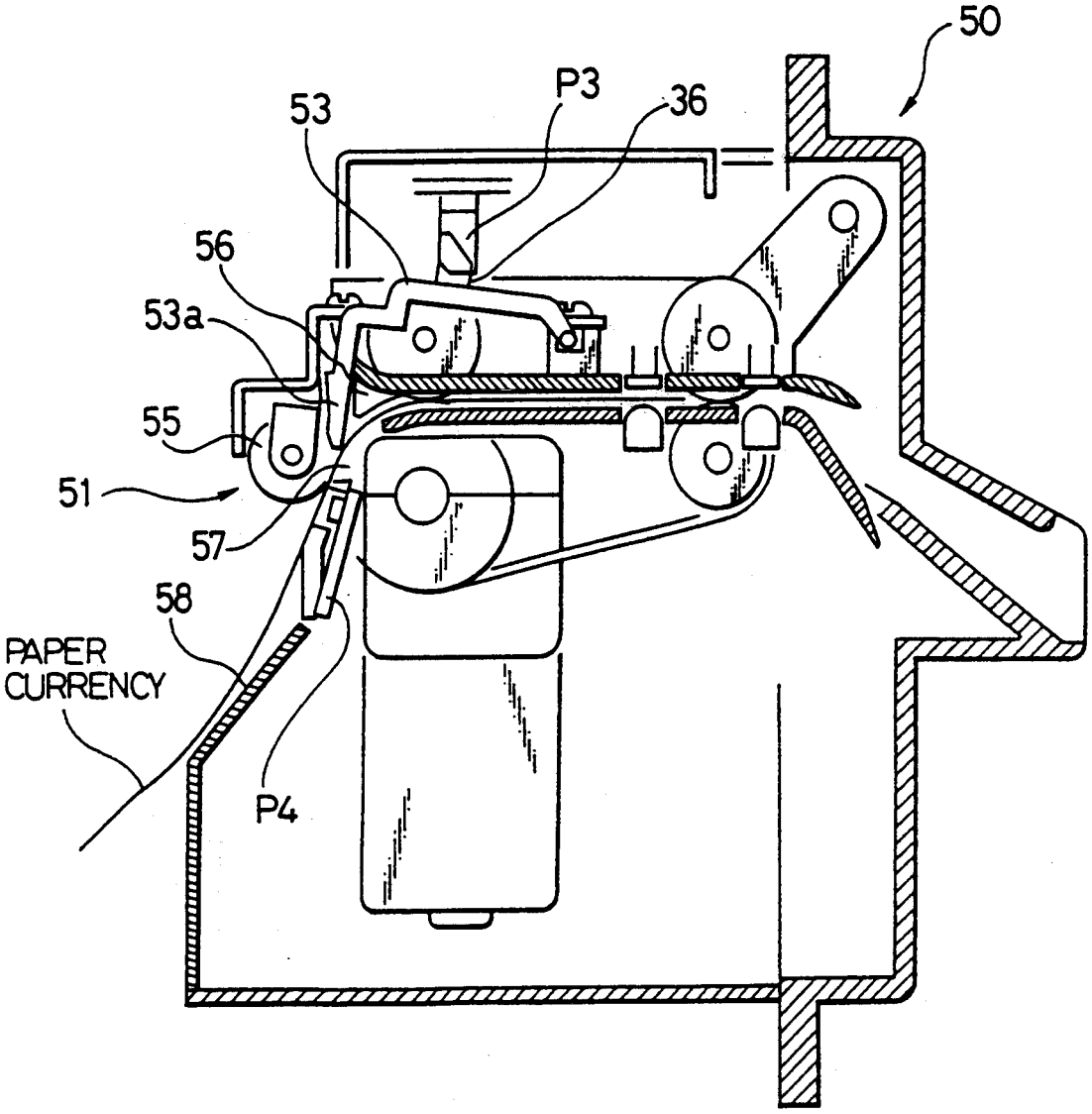
FIG. 15 is a sectional side elevation showing the rocking state of an extraction preventing lever.

When the paper currency moves farther so that its leading ends reaches the course regulating member 56, its leading end comes into sliding contact with the sliding face of the course regulating member 56 and is gradually bent downward to lift the leading end 53*a* of the extraction preventing lever 53 so that this lever 53 rocks from the position of FIG. 13 to the position of FIG. 15. As a result, the passage detecting sensor P3 has its output turned ON. Then, the paper currency having its leading end held between the pinch roller 55 composing the forced transfer means 51 and the timing belts 14 running on the timing pulleys 8 is warped in the width direction of the paper currency by the projection 52 in sliding contact with the central portion of the lower face of the paper currency so that it is transferred forward as it is until it is fed to the paper currency recovery chute 58 communicating with the stacker.

Moreover, when the paper currency being transferred further moves as far as its trailing end passes over the position of the shutter member 24, the leading end of this member 24 is brought into the hole 30 of the lower transfer plate 4 as in the foregoing embodiment so that the paper currency transfer passage 6 is completely closed just upstream of the magnetic heads 21 and the transfer position detecting sensor P2.

Moreover, when the paper currency moves to the position, which is required for reading the discrimination data, as far as its trailing end reaches the discrimination data reading end position, the transfer of the paper currency by the timing belts 14 driven by the DC motor M1 is temporarily stopped, and the read discrimination data of the inserted paper currency are compared with the normal data presenting a reference. The paper currency is returned, if it is counterfeit, to the user by the returning operations similar to those of the foregoing embodiment.

In case, on the other hand, it is confirmed that the inserted paper currency is genuine, the forward drive of the DC motor M1, i.e., the forward transfer of the paper currency by the timing belts 14 is reopened while retaining the output of the result of decision. From now on, the drive of the DC motor M1 is continued till the trailing end of the genuine paper currency having been temporarily stopped at the discrimination data reading ending position passes over the position of the transfer position detecting sensor P2. More-over, whether or not the extraction has been conducted is detected on the basis of the combination of the ON/OFF states of the transfer position detecting sensor P2 and the passage detecting sensor P3 (as corresponds to the operations of Steps S25 and S26 of FIG. 7), as in the foregoing embodiment, till the passage detecting sensor P3 is turned OFF so that the paper currency has its end run over the projection 52 and is recovered (that is, till the decision of Step S26 answers "NO" at Step S26 of FIG. 7).

Here, the difference between the paper currency discriminating device 50 of the present embodiment and the paper currency discriminating device 1 of the foregoing embodiment resides especially in the shapes of the extraction preventing levers 53 and 33 for actuating the passage detecting sensor P3.

The extraction preventing lever 53 of the paper currency discriminating device 50 of the present embodiment has its leading end 53*a* made as wide as the width of the paper currency and is not biased to rock to the original position by any special bias means. As a result, even after the end of the paper currency has been transferred to the paper currency recovery chute 58 over the positions of the extraction preventing lever 53 and the projection 52, the leading end 53*a* of the extraction preventing lever 53 can be easily lifted over the paper currency transfer face of the forcible transfer means 51 by the tension acting upon the thread and tape which has its two ends held by the paper currency and the hand of the user. There-fore, in case the illegal means is the tape which itself has such a higher hardness than a predetermined level as will lift the extraction preventing lever 53, it does not actually occur that the extraction preventing lever 53 restores its original position to turn OFF the passage detecting sensor P3 despite of the fact that the illegal means is attached to the paper currency. Thus, the answer of decision of the genuineness/counterfeitness of the paper currency is not outputted.

Figure 7:
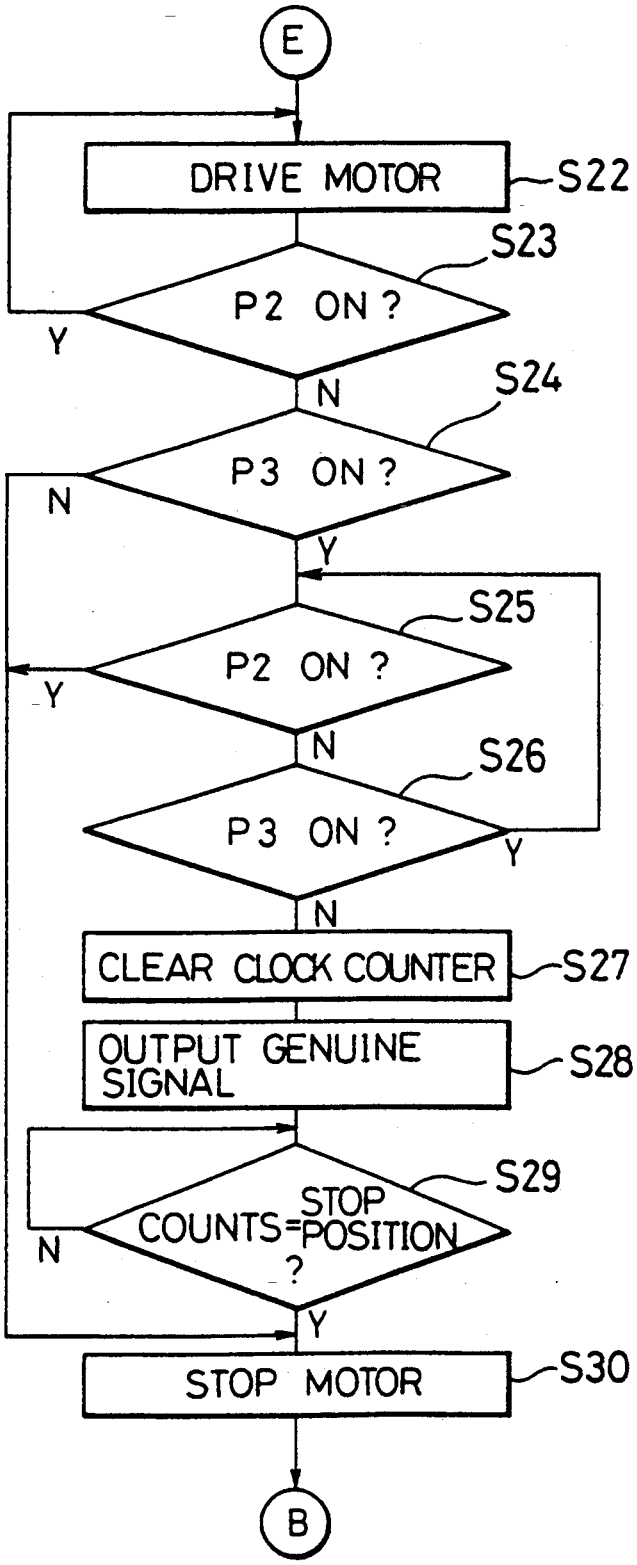
FIG. 7 is a continuation of the flow chart schematically showing the control program.

If the paper currency is then forcibly extracted, it is confirmed by the operation corresponding to Step S25 of FIG. 7 that the transfer position detecting sensor P2 was turned ON, and the returning operation similar to that of the aforementioned embodiment is executed. The paper currency fitted with a tape or the like is either returned by that returning operation or introduced together with the tape so that the answer of decision of the genuineness/counterfeitness is outputted (as corresponds to the operation of Step S28 of FIG. 7) when both the passage detecting sensor P3 and the paper currency introduction confirming sensor P4 are turned OFF.

In case, on the other hand, the illegal means attached to the paper currency is exemplified by the thread made of a soft material, the extraction preventing lever 53 restores its original position by its own weight, when the end of the paper currency is transferred to the paper currency recovery chute 58 over the positions of the extraction preventing lever 53 and the projection 52, so that the passage detecting sensor P3 can possibly be turned OFF (as corresponds to the timing at which the answer of decision of Step S26 of FIG. 7 is NO). At this instant, however, the trailing end of the paper currency has already passed over the position of the projection 52, and the ride of the paper currency over the projection 52 has dissolved the warp in the width direction of the paper currency to some extent. As a result, the paper currency is liable to have its trailing end caught by the lower face 52*b* of the projection 52 so that it can hardly be extracted. In case the thread attached to the widthwise central portion of the paper currency happens to ride on the upper slope 52*a* of the projection 52, it seems that the trailing end of the paper currency is not caught by the lower face 52*b* of the projection 52 but guided to the upper slope 52*a* even if the thread is pulled. However, since the leading end 53*a* of the extraction preventing lever 53 protrudes into the slit 57 across the projection 52, the edge of the paper currency to be pulled back along the upper slope 52*a* of the projection 52 never fails to come into abutment against the leading end 53*a* of the extraction preventing lever 53 so that any further pullback is inhibited.

On the other hand, the trouble detecting timer starts its countering operation (as corresponds to the timing that the answer of decision of Step S26 of FIG. 7 turns "YES") when the end portion of the paper currency is transferred over the positions of the extraction preventing lever 53 and the projection 52 to the paper currency recovery chute 58. As a result, the returning operations similar to those of the foregoing embodiments are executed, if the illegal operation using the thread or tape is executed to turn ON the paper currency introduction confirming sensor P4 for a predetermined or longer time period.

In case the paper currency introduction confirming sensor P4 is used as a filled up state confirming sensor, there are executed independently of the aforementioned individual operations for every predetermined period: the operation of confirming the ON/OFF states of the paper currency introduction confirming sensor P4; and the operations of resetting and restarting the filled up state detecting timer, if it is decided that the paper currency introduction confirming sensor P4 is OFF, and deciding whether or not the time counted by the filled up state detecting timer reaches a preset value, if it is decided that the sensor P4 is ON, to output a full stacker signal if the preset value is reached. As a result, the full stacker signal is outputted, as shown in FIG. 14, if the stacker is filled up to block the flow of paper currency sliding down on the paper currency recovery chute 58 so that the paper currency introduction confirming sensor P4 is always ON.

In the construction for preventing the illegal extraction by using the projection allowing only the forward passage of paper currency and the paper currency forced transfer means, as in the present embodiment, when the paper currency insertion sensor detects the insertion of paper currency, the paper currency transfer means is driven to start the transfer of paper currency in the direction of insertion, and the paper currency forced transfer means associated with the paper currency transfer means rotates in the paper currency transferring direction so that the paper currency information detecting means detects the information for the paper currency discrimination in the course of transferring the paper currency. The inserted paper currency is transferred by the paper currency transfer means to pass over the projection disposed between the exit of the paper currency transfer passage and the forced transfer means and is further fed while being held by the paper currency forced transfer means rotating in the paper currency transferring direction, until it is recovered by the paper currency discriminating device.

When the transfer of the paper currency is ended, the drive of the paper currency transfer means is stopped to stop the rotation of the paper currency forced transfer means associated with the paper currency transfer means. The passage detecting sensor allows the output of the paper currency decision signal which is based upon the discrimination information read by the information detecting means, after the paper currency passed over the projection so that it detected that the rocking extraction preventing lever made as wide as the paper currency closed the exit of the paper currency transfer passage.

The extraction preventing lever for closing the exit of the paper currency transfer passage substantially at the same position of the projection, as taken in the direction facing the projection, over the paper currency transfer face of the forced transfer means with the width equivalent to that of the paper currency closes the paper currency transfer passage, as the paper currency passes, to prevent the extraction of the paper currency together with the projection. Even if the paper currency is to be extracted by pulling the thread or tape attached to the paper currency after the paper currency has passed over the projection, the end of the paper currency is regulated by the paper currency transfer face of the forced transfer means and is caught by the projection. As a result, the paper currency cannot be extracted, and the thread or tape attached thereto is cut by the forcible extracting action so that the paper currency freed from the thread or tape is recovered by the paper currency discriminating device.

In case, moreover, the paper currency is to be extracted by pulling the thread or tape attached thereto, the extraction preventing lever is lifted to the paper currency transfer face to obstruct the operation of the passage detecting sensor by the tension acting upon the thread or tape, no matter where the thread or tape might be attached or no matter how wide the thread or tape might be. As a result, the discrimination information detected from the paper currency is invalidated. The paper currency recovery chute connected with the exit end of the transfer means is arranged with the paper currency introduction confirming sensor so that the paper currency decision signal is outputted after the passage of the paper currency has been detected by the passage detecting sensor and the paper currency introduction confirming sensor. As a result, it is possible to prevent more reliably the output of the genuineness signal in case the paper currency is pulled back by the thread or tape.

Moreover, the paper currency introduction confirming sensor can be used as the filled up state detecting sensor, too, so that no special detecting means is required for confirming the fullness of the stacker.

What is claimed is:

1. A paper currency discriminating device comprising: a paper currency transfer passage having upper and lower transfer plates facing each other at a predetermined clearance; a paper currency transfer means for transferring paper currency inserted from one end of an entrance of said paper currency transfer passage to an other end of an exit of the same along said paper currency transfer passage; a paper currency insertion sensor for detecting that the paper currency has been inserted into said paper currency transfer passage; and paper currency information detecting means for discriminating the paper currency in said paper currency transfer passage, wherein the improvement comprises: an impeller arranged outside of the exit of said paper currency transfer passage at a predetermined gap from an edge of said upper transfer plate, impeller having vanes with leading ends of said vanes protruding upward over a paper currency transfer face of said upper transfer plate; and a drive source for driving said paper currency transfer means to drive said impeller rotationally.

2. A paper currency discriminating device comprising: a paper currency transfer passage having upper and lower transfer plates facing each other at a predetermined clearance; a paper currency transfer means for transferring paper currency inserted from one end of an entrance of said paper currency transfer passage to an other end of an exit of the same along said paper currency transfer passage; a paper currency insertion sensor for detecting that the paper currency has been inserted into said paper currency transfer passage; and paper currency information detecting means for discriminating the paper currency in said paper currency transfer passage, wherein the improvement comprises: an impeller arranged outside of the exit of said paper currency transfer passage at a predetermined gap from an edge of said upper transfer plate, said impeller having vanes with leading ends of said vanes protruding upward over a paper currency transfer face of said upper transfer plate; and means mounted on said impeller for allowing rotations only in a paper currency transferring direction but inhibiting reverse rotations.

3. A paper currency discriminating device according to claim 1 or 2, further comprising a projection disposed outside of the exit of said paper currency transfer passage and extending downward of said transfer passage from the edge of said upper transfer plate such that its leading end faces the leading ends of the vanes of said impeller at a predetermined gap.

4. A paper currency discriminating device according to claim 1 or 2, further comprising: paper currency passage detecting means for detecting that the paper currency having left the exit of said paper currency transfer passage passes over said impeller, so that when the passage of the paper currency through said impeller is detected by said paper currency passage detecting means, a paper currency passage detecting signal is fed to said paper currency information detecting means to allow the output of a paper currency decision signal based upon the discrimination information read by said paper currency information detecting means.

5. A paper currency discriminating device according to claim 4, wherein said paper currency passage detecting means includes: a lever-shaped member having its base end hinged rotatably to a bracket fixed on said upper transfer plate and extending downstream of said transfer passage so far as its leading end projects slightly downward of the paper currency transfer face of said lower transfer plate while facing the outside of the exit of said transfer passage; and a sensor for deciding the state, in which said lever-shaped member rotates to have its leading end projected downward over the paper currency transfer face of said lower transfer plate, or the state in which said lever-shaped member is blocked from any further downward movement by the paper currency which is being transferred by the vanes of said impeller.

6. A paper currency discriminating device according to claim 5, wherein said lever member is bent slight downward, while being extended downstream of said transfer passage from its base end hinged rotatably to the bracket fixed on said transfer plate, to have its leading end projected over a level of the paper currency transfer face of said upper transfer plate through the gap between said impeller and the edge of said lower transfer plate at the exit side of said transfer passage and further slightly downward over the paper currency transfer face of said lower transfer plate, and said lever member has its leading end biased rotationally to protrude downward over the paper currency transfer face of said lower transfer plate so that said rotationally biased lever member can prevent the paper currency, which has been once introduced in the rotational direction of said impeller from the position of said impeller, from being moved and returned backward to midway of said paper currency transfer passage from the exit of said paper currency transfer passage.

7. A paper currency discriminating device according to claim 3, further comprising: paper currency passage detecting means for detecting that the paper currency having left the exit of said paper currency transfer passage passes over said impeller, so that when the passage of the paper currency through said impeller is detected by said paper currency passage detecting means, a paper currency passage detecting signal is fed to said paper information detecting means to allow the output of a paper currency decision signal based upon the discrimination information read by said paper currency information detecting means.

8. A paper currency discriminating device according to claim 7, wherein said paper currency passage detecting means includes: a lever-shaped member having its base end hinged rotatably to a bracket fixed on said upper transfer plate and extending downstream of said transfer passage so far as its leading end projects slightly downward of the paper currency transfer face of said lower transfer plate while facing outside of the exit of said transfer passage; and a sensor for detecting the state, in which said lever-shaped member rotates to have its leading end projected downwardly over the paper currency transfer face of said lower transfer plate, or the state in which said lever-shaped member is blocked from any further downward movement by the paper currency which is being transferred by the vanes of said impeller.

9. A paper currency discriminating device according to claim 1, 2, 5, 6, or 7, further comprising: a shutter disposed in the vicinity of said paper currency insertion sensor and downstream of said paper currency insertion sensor in the paper currency transferring direction for opening or closing said paper currency transfer passage when energized by a solenoid; and shutter control means for energizing said solenoid to open said paper currency transfer passage if the passage of the paper currency is detected by said passage detecting sensor and if the paper currency is then detected by said paper currency insertion sensor.

10. A paper currency discriminating device comprising a paper currency transfer passage having upper and lower transfer plates facing each other at a predetermined clearance; a paper currency transfer means for transferring paper currency inserted from one end of an entrance of said paper currency transfer passage to an other end of an exit of same along said paper currency transfer passage; a paper currency insertion sensor for detecting that the paper currency has been inserted into said paper currency transfer passage; and paper currency information detecting means for discriminating the paper currency in said paper currency transfer passage, wherein the improvement comprises:

paper currency forced transfer means disposed outside of the exit of said paper currency transfer passage and engaging with the paper currency, which is being sent out from said paper currency transfer passage, for transferring the paper currency forcibly in a direction apart from the exit of said paper currency transfer passage, said paper currency forced transfer means comprising a pinch roller mounted on said upper transfer plate and biased by a spring and a drive source for rotationally driving said pinch roller; and a projection formed in a widthwise central portion of said lower transfer plate at the exit of said paper currency transfer passage and shaped to extend in the paper currency transferring direction of said paper currency transfer passage and downward at an inclination to have its leading end extended to a position slightly exceeding the paper currency transfer passage, said position being defined by said paper currency forced transfer means, so that said projections may not block the transfer of the paper currency being transferred from the exit of said paper currency transfer passage by said paper currency forced transfer means but may block the reverse movement of the paper currency if the paper currency positioned below the position of said paper currency forced transfer means is moved backward to the exit of said transfer passage.

11. A paper currency discriminating device comprising a paper currency transfer passage having upper and lower transfer plates facing each other at a predetermined clearance; a paper currency transfer means for transferring paper currency inserted from one end of an entrance of said paper currency transfer passage to other end of an exit of the same along said paper currency transfer passage; a paper currency insertion sensor for detecting that the paper currency has been inserted into said paper currency transfer passage; and paper currency information detecting means for discriminating the paper currency in said paper currency transfer passage, wherein the improvement comprises:

paper currency forced transfer means disposed outside of the exit of said paper currency transfer passage for forcibly transferring the paper currency, which is fed out from said paper currency transfer passage, in a direction apart from the exit of said paper currency transfer passage by engaging with the paper currency, said paper currency forced transfer means comprising a pinch roller mounted on said upper transfer plate and biased by a spring and a drive source for rotationally driving said pinch roller;

an extraction preventing lever made of a plate-shaped member, which has its base end hinged rotatably to said upper transfer plate and a width substantially equal to that of the paper currency, and shaped to extend in the transfer direction of said paper currency transfer passage and bent downward to partially reach the paper currency transfer face of said lower transfer plate over the paper currency transfer face of said upper transfer plate thereby to clog the exit of said paper currency transfer passage substantially; and a paper currency transfer passage detecting sensor for discriminating the state, in which said extraction prevention lever is turned by having its leading end pushed up by the paper currency being transferred in the vicinity of the exit of said paper currency transfer passage, and the state in which said extraction preventing lever is turned downward because no paper currency is present at the leading end thereof; and wherein if it is detected by said paper currency passage detecting sensor that the paper currency has passed while pushing up said extraction preventing lever, a passage detection signal is fed to said paper currency information detecting means to allow the output of a paper currency decision signal based upon the discrimination signal read by said paper currency information detecting means.

12. A paper currency discriminating device according to claim 11, wherein said extraction preventing lever has a leading end formed at a widthwise center with a notch for preventing interference with a projection from said lower transfer plate such that the leading end of said extraction preventing lever rides across said projection protruded from said lower transfer plate over a paper currency transfer face in said paper currency forced transfer means, so that it can protrude to the side of said lower transfer plate over said projection and the paper currency transfer face of said paper currency forced transfer means.

13. A paper currency discriminating device according to claim 10 or 12, wherein said paper currency transfer means for transferring the paper currency to the other end of said exit along said paper currency transfer passage includes a timing belt made to run on a pair of timing pulleys, and wherein said upper transfer plate has formed on a lower face of an exit end with a wedge-shaped course regulating member having a generally arcuate sliding face formed along the outer circumference of the timing pulley located at the exit of said paper currency transfer passage.

14. A paper currency discriminating device according to claim 13 further comprising: a paper currency recovery shoot arranged downstream of said paper currency forced transfer means in the paper currency transferring direction; and a paper currency introduction confirming sensor interposed between said paper currency forced transfer means and said paper currency recovery shoot, and wherein the output of the paper currency decision signal based upon the discrimination information read by said paper currency information detecting means is allowed after the passage of the paper currency has been detected by said paper currency introduction confirming sensor and said passage detection sensor.

15. A paper currency discriminating device according to claim 14, wherein said paper currency introduction confirming sensor also acts as a stacker fill-upstate detecting sensor for outpouring a stacker filled-up state signal if it continuously detects the paper currency for a predetermined or a longer time period.

16. A paper currency discriminating device according to any of claim 10 or 12, further comprising: a paper currency recovery chute arranged downstream of said paper currency forced transfer means in the paper currency transferring direction; and a paper currency introduction confirming sensor interposed between said paper currency forced transfer means and said paper currency recovery chute, and wherein the output of the paper currency decision signal based upon the discrimination information read by said paper currency information detecting means is allowed after the passage of the paper currency has been detected by said paper currency introduction confirming sensor and said passage detecting sensor.

17. A paper currency discriminating device according to claim 16, wherein said paper currency introduction confirming sensor also acts as a stacker filled-up state detecting sensor for outputting a stacker filled-up state signal if it continuously detects the paper currency for a predetermined or longer time period.

* * * * *